US010704222B2

(12) United States Patent
Grussenmeyer et al.

(10) Patent No.: US 10,704,222 B2
(45) Date of Patent: Jul. 7, 2020

(54) REINFORCEMENT DEVICES, SYSTEMS AND METHODS FOR CONSTRUCTING AND REINFORCING THE FOUNDATION OF A STRUCTURE

(71) Applicant: SWS Innovations, LLC, Chatham, IL (US)

(72) Inventors: Philip J. Grussenmeyer, Chatham, IL (US); Steven Robert Beach, Varna, IL (US)

( * ) Notice: Subject to any disclaimer, the term of this patent is extended or adjusted under 35 U.S.C. 154(b) by 0 days.

(21) Appl. No.: 16/200,973

(22) Filed: Nov. 27, 2018

(65) Prior Publication Data

US 2019/0119876 A1 Apr. 25, 2019

Related U.S. Application Data

(63) Continuation-in-part of application No. 15/720,157, filed on Sep. 29, 2017.

(60) Provisional application No. 62/401,381, filed on Sep. 29, 2016.

(51) Int. Cl.

| | |
|---|---|
| ***E02D 37/00*** | (2006.01) |
| ***E04G 23/02*** | (2006.01) |
| ***E02D 5/64*** | (2006.01) |
| ***E04C 3/00*** | (2006.01) |

(Continued)

(52) U.S. Cl.

CPC ..... *E02D 37/00* (2013.01); *E02D 5/64* (2013.01); *E04B 1/3522* (2013.01); *E04C 3/005* (2013.01); *E04G 23/02* (2013.01); *E04G 23/0229* (2013.01); *E04H 12/2284* (2013.01); *E02D 2200/11* (2013.01)

(58) Field of Classification Search

CPC ..... E04C 3/005; E04H 12/2284; E02D 5/64; E02D 37/00; E02D 2200/11; E04B 1/3522; E04G 23/02; E04G 23/0229

See application file for complete search history.

(56) References Cited

U.S. PATENT DOCUMENTS 2,280,220 A * 4/1942 Crosby ..... E04B 1/36 52/126.6
2,874,812 A * 2/1959 Clevett, Jr. ..... E04C 3/005 182/163
3,027,140 A 3/1962 Holzbach (Continued)

OTHER PUBLICATIONS

Brochure—Osmose Truss Systems (www.osmose.com).

(Continued)

*Primary Examiner* — Andrew J Triggs

(74) *Attorney, Agent, or Firm* — Stephen T. Scherrer; Monique A. Morneault; Scherrer Patent & Trademark Law, P.C.

(57) ABSTRACT

The present disclosure relates to reinforcement devices, systems and methods for use in constructing new structures, including post frame structures. Specifically, the present disclosure relates to reinforcement devices, systems and methods for replacing traditional wood and/or precast concrete columns utilized in building a new construction foundation, with a height adjustable foundation column assembly constructed from a corrosion resistant material. The present disclosure also relates to reinforcement devices, systems and methods useful for reinforcing existing post frame structures, particularly those with framing elements requiring repair.

17 Claims, 22 Drawing Sheets

(51) Int. Cl.
*E04B 1/35* (2006.01)
*E04H 12/22* (2006.01)

(56) References Cited

U.S. PATENT DOCUMENTS

| | | | | |
|---|---|---|---|---|
| 5,819,482 | A * | 10/1998 | Belke | E04C 3/005 52/126.6 |
| 6,079,165 | A | 6/2000 | Bingel, III et al. | |
| 6,349,512 | B1 | 2/2002 | Berkey | |
| 6,964,139 | B2 | 11/2005 | Meyer et al. | |
| 7,343,713 | B2 | 3/2008 | Knepp et al. | |
| 7,363,752 | B2 | 4/2008 | Bingel, III et al. | |
| 7,454,872 | B2 | 11/2008 | Cutforth | |
| 7,574,841 | B2 | 8/2009 | Knepp et al. | |
| 7,677,522 | B2 | 3/2010 | Bakos | |
| 8,235,346 | B2 | 8/2012 | Bakos | |
| 8,381,462 | B1 | 2/2013 | Sims | |
| 8,397,442 | B2 * | 3/2013 | Laurin | E02D 27/32 52/126.6 |
| 8,407,967 | B2 * | 4/2013 | Brindle, Jr. | E04C 3/005 52/126.7 |
| 8,453,416 | B2 * | 6/2013 | Brindle | E04C 3/32 52/126.7 |
| 8,826,629 | B1 * | 9/2014 | Brindle | E04C 3/005 52/126.7 |
| 9,217,248 | B2 * | 12/2015 | Knepp | E04C 3/005 |
| 9,366,052 | B1 | 6/2016 | Warner et al. | |
| 9,540,814 | B2 | 1/2017 | Meyer et al. | |
| 9,677,297 | B2 | 6/2017 | Warner et al. | |
| 9,732,521 | B2 * | 8/2017 | Babikian | E04B 2/74 |
| 2003/0006354 | A1 | 1/2003 | Biles | |
| 2004/0113030 | A1 * | 6/2004 | Wang | E04C 3/005 248/146 |
| 2004/0163334 | A1 * | 8/2004 | Carlson | E04F 15/02 52/126.6 |
| 2005/0056760 | A1 * | 3/2005 | Carlson | E04G 11/48 248/354.3 |
| 2009/0293422 | A1 | 12/2009 | Brindle, Jr. | |
| 2010/0098499 | A1 | 4/2010 | Bakos | |
| 2010/0129147 | A1 | 5/2010 | Wrightman | |
| 2010/0300038 | A1 | 12/2010 | Brindle | |
| 2014/0260082 | A1 * | 9/2014 | Brindle | E04C 3/005 52/831 |
| 2014/0373471 | A1 * | 12/2014 | Knepp | E04C 3/005 52/296 |
| 2017/0073972 | A1 | 3/2017 | Gilbert et al. | |
| 2018/0087273 | A1 * | 3/2018 | Grussenmeyer | E04C 3/07 |

OTHER PUBLICATIONS https://www.strongtie.com/nonstandoffcolumnbases_columnbases/cbqgt_base/p/cbqgt.
https://www.strongtie.com/standoffcolumnbases_columnbases/cbs-cbsq_productgroup_wcc/p/cbs.cbsq.
https://www.permacolumn.com/products/sturdi-wall.
https://www.concretepiersystem.com.
http://www.postframeadvantage.com/design/foundations/poured-in-place-concrete-pier.

* cited by examiner

REINFORCEMENT DEVICES, SYSTEMS AND METHODS FOR CONSTRUCTING AND REINFORCING THE FOUNDATION OF A STRUCTURE

This application is a continuation-in-part of U.S. Ser. No. 15/720,157 filed on Sep. 29, 2017, which claims priority to U.S. Provisional Application Ser. No. 62/401,381 filed Sep. 29, 2016, which is incorporated in its entirety herein.

TECHNICAL FIELD

The present invention relates to reinforcement devices, systems and methods useful for constructing and reinforcing a structure. Specifically, one embodiment of the reinforcement device is an adjustable foundation system for use as reinforcement structural columns, posts and/or supports for a structure, particularly for use in new construction of pole barns and other buildings. The present invention further includes a reinforcement device useful for securing to and stabilizing existing structural posts of a building such as wooden support columns of a post frame or pole buildings. The present invention also relates to a system and method for raising the height of an existing building or structure using a reinforcement device, thereby providing more useful interior space for accommodating large pieces of equipment and/or for providing more storage capacity.

BACKGROUND

It is, of course, generally known to construct a structure, such as a shed, barn, garage, etc., using wooden posts set into a series of holes dug in the ground to define a perimeter and create the initial frame for the structure. In the case of pole barns, the structural or framing posts are buried in the ground, and often surrounded by dirt, gravel or concrete. However, long-term contact of wooden posts with the ground can lead to post rot of these wood pilings, resulting in potential structural failure, often prematurely. Additionally, many older structures, such as older barns, with wood columns embedded into the ground subject to decay, rotting, and insect infestation, which can affect the overall integrity of the structure. However, it is often desirable to repair older, wood frame structures to maintain their integrity for various reasons including costs, convenience and history.

Improvements continue to be made to provide longevity, durability and strength to post frame buildings. The traditional method of repair requires that large holes be excavated within the building next to and/or around each post. A new post is then installed next to the existing post and the posts are bolted together. With this traditional method, there is typically no new foundation installed and no additional uplift protection. Opening up large holes including breaking and tearing out concrete flooring around the existing columns is invasive, labor intensive and costly. Additionally, most traditional repairs will take several days to a week to complete, and can be expensive.

For decades, post frame buildings were built all across America that were designed to store equipment and machinery that was much smaller in stature than what is in use on today's modern farms. As a result, many of these otherwise useful buildings are being removed to make room for new buildings with higher interior clearances to accommodate today's larger farm machinery. However, razing a structure and building a new one can be time-consuming and expensive. Additionally, many older structures have value, not only historically but may also have sentimental value to the owner. Therefore, a need exists for refurbishing existing buildings by extending existing wood columns to increase the interior space clearance, thereby providing the interior height and space needed for today's modern farm equipment.

Additionally, there exists a need for options to the traditional wood post construction of foundations for new buildings. Replacing traditional wood foundations with easy to use columns made of material able to withstand rot, decay and insect damage that traditional wooden posts are susceptible to, or expand and contract due to freezing and thawing, results in a structure more durable and well-protected against destructive natural forces than the average post frame building foundation. Because each column can be stabilized and adjusted both vertically and horizontally the integrated grade board bracket allows the wall post to interlock. This allows the entire foundation system to be stabilized and minor, if any, post movement occurs when backfilling the excavated holes with concrete, resulting in a solid, precise foundation system. Moreover, the lack of pre-cast concrete posts eliminates the possibility of blow outs that can compromise the integrity of the foundation's concrete.

A need, therefore, exists for improved devices, systems and methods for reinforcing a structure. Specifically, a need exists for improved devices, systems and methods for reinforcing and stabilizing failing structural elements including structural and framing posts quickly and easily.

A need further exists for improved devices, systems and methods for providing a reinforcement device for use in constructing an improved foundation for a structure wherein the foundation is resistant to the elements, rot and decay and insect infestation.

Additionally, a need exists for improved devices, systems and methods for constructing a foundation using preassembled columns, and the pre-drilled holes which make for simple attachment to boards and planks used in the construction of a foundation for a structure. This saves time and increases labor efficiency.

A need further exists for improved devices, systems and methods for constructing a foundation utilizing columns much lighter than traditional wooden posts or precast concrete columns, making lifting safer and easier for the worker and reducing the need for heavy machinery to assist in transportation and installation.

Further, a need exists for improved devices, systems and methods for providing a reinforcement device useful in raising the height of an existing structure.

Moreover, a need exists for improved devices, systems and methods for reinforcing wooden posts or columns of an existing structure using fewer tools and workers to install the device.

A need further exists for improved devices, systems and methods for providing an efficient and time-saving structurally sound repair to failing columns supporting a building.

Additionally, a need exists for improved devices, systems and methods for constructing a new structure while further protecting it from future decay and potential insect infestation.

A need further exists for improved devices, systems and methods reinforcing and stabilizing a structure utilizing a multi-sided sleeve device for surrounding and reinforcing an existing structural wooden post.

A need further exists for improved devices, systems and methods for stabilizing a structure and providing additional uplift and lateral strength to increase the height of an existing structure thereby increasing the useful interior space of the structure. Often minor height loss is due to sagging from the breakdown of wood columns and settlement.

Additionally, a need exists for repairing and or straightening sagging walls, and providing improved structural integrity to an existing structure so it can better withstand damage from storms, including potential wind damage.

Moreover a need exists for improved devices and systems adaptable for reinforcing a structural element, such as a post for a pole building, have a variety of shapes and sizes.

Further, a need exists for improved devices, systems and methods for a structurally sound repair of existing structural columns at a fraction of the cost to replace existing structural elements or even an entire structure.

SUMMARY

The present disclosure relates to reinforcement devices, systems and methods for use in constructing new structures, and repairing post frame structures. Specifically, the present disclosure relates to foundation systems, reinforcement devices, systems and methods for replacing traditional wood and/or precast concrete posts traditionally utilized in constructing or repairing existing post frame foundation components. The present disclosure provides a height adjustable foundation column for use in constructing a foundation for new construction. The height adjustable foundation column assembly is ideally constructed from corrosion resistant materials.

In one exemplary embodiment, the present disclosure relates to a reinforcement device for constructing and supporting a foundation for a structure, the device comprising a column body having a top and a bottom, a bracket secured to the top of the column body, a height adjustment mechanism positioned above and passing through the bracket and within an interior space of the column body extending from top to bottom, the adjustment mechanism capable of vertically moving the column body and bracket between any desired height, and, a stabilizer pad secured to an end of the height adjustment mechanism opposing the top of the column body.

In another embodiment, the present disclosure relates to a height adjustable assembly for constructing and supporting a foundation for a structure. The assembly comprises a column body having a top, a bottom and an interior space, at least one upright arm secured to a horizontal base at the top of the column body, a height adjustment mechanism including: a rod passing through an opening in the base, a hollow cylinder extending vertically and separated from an undersurface of the base, and, an extension rod extending upward through the interior space of the column body and into an interior of the cylinder, wherein the rod enters the interior of the cylinder for engagement with the extension rod to vertically move the column body and bracket between any desired height.

In yet another embodiment, the present disclosure relates to a method for creating a foundation for a structure. The method includes the steps of outlining a perimeter of a structure through the excavation of a plurality of holes, providing a height adjustable column assembly comprising, a column body having a top and a bottom, a bracket secured to the top of the column body, a height adjustment mechanism extending above and downward through the bracket within an interior space of the column body, the height adjustment mechanism capable of vertically moving the column body and bracket between any desired height; and, a stabilizer pad secured to an end of the height adjustment mechanism opposite the top of the column body, positioning each height adjustable column assembly within each hole forming the perimeter, wherein the bracket is above ground level and the stabilizer pad is positioned at the bottom of the hole, adjusting each height adjustable column assembly through the height adjustment mechanism to an acceptable level position; and, disposing at least one board on each of the brackets, forming an initial foundation for the structure.

In another exemplary embodiment, the present disclosure relates to a reinforcement device useful for securing to and stabilizing existing structural posts of a building such as wooden support columns of a post frame or pole buildings. The reinforcement device has a multi-sided corrugated structure, which is adaptable for engagement with structural posts having a variety of shapes and sizes. Additionally, the present disclosure relates to a system and method for increasing the height of an existing structure, due to sagging from a breakdown of wood columns and settlement, or increasing the height of the entire structure, thereby increasing the useable interior clearance space to accommodate large pieces of equipment.

To this end, in an embodiment of the present invention, a device for reinforcing an existing structural element of a building is provided. The device comprises a multi-sided sleeve having an elongated body comprising a longitudinal center section integrally connected along opposing edges to a pair of opposing longitudinal legs or panels having a length the same as the center section. Each leg is connected at an angle or bend to the center section, wherein the angle can vary depending on the size of the structural element.

In an embodiment, a reinforcement device is provided for use in reinforcing an existing structural column. The reinforcement device comprises a multi-sided structure, having a center longitudinal section flanked on either side and integrally connected to a pair of opposing legs, wherein the legs have the same longitudinal length as the center section. Each of the center section and legs further include a raised portion or apex substantially in the middle of the center section and each leg, wherein the raised portions provide an overall corrugated structure to the device and intermittent contact with the column.

In another embodiment of the present invention, a system and method for increasing the height and interior space of an existing structure is provided. The system and method includes the steps of providing an suitable reinforcement device, creating a space around an existing column or post, placing the reinforcement device around the existing column, driving the reinforcement device below grade to the original foundation pad, cutting the existing column and supporting it with the reinforcement device, and lifting the structure to the desired height. Once this is achieved a wood spacer block can be installed between the severed column to direct the load back to the original foundation. Fasteners are installed to adjoin the pieces together.

It is, therefore, an advantage and objective of the present disclosure to provide a reinforcement device, system and method useful for creating a foundation for a structure that is resistant to temperature changes, decay, and insect infestation.

It is, therefore, an advantage and objective of the present disclosure to provide a reinforcement device, system and method for reinforcing and stabilizing existing structural elements of a building including structural and framing posts, quickly and easily.

It is further an advantage and objective of the present disclosure provide an improved reinforcement device, system and method for stabilizing a structure and providing reinforcement to existing foundation columns and uplift strength to increase the height of an existing structure thereby increasing the useful interior space of the structure or to lift to correct any sagging resulting from failing wood columns.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present disclosure relates to devices, systems and methods for constructing a foundation and replacing the traditional wood and/or precast concrete columns used for supporting a structure, such as a post-frame building. Specifically, the present disclosure relates to improved reinforcement devices, systems and methods useful in the construction of solid, corrosion-resistant foundations for new buildings, including pole or post-frame buildings. The present disclosure also relates to another embodiment of improved reinforcement devices, systems and methods useful for reinforcing and stabilizing existing structural posts of a building, such as existing wooden columns of a post frame or pole buildings. Additionally, the present disclosure relates to a system and method for utilizing a reinforcement device for increasing the height of an existing structure, thereby increasing the useful interior space of a structure to accommodate larger pieces of equipment and machinery and/or to provide additional storage capacity.

Figure 11:
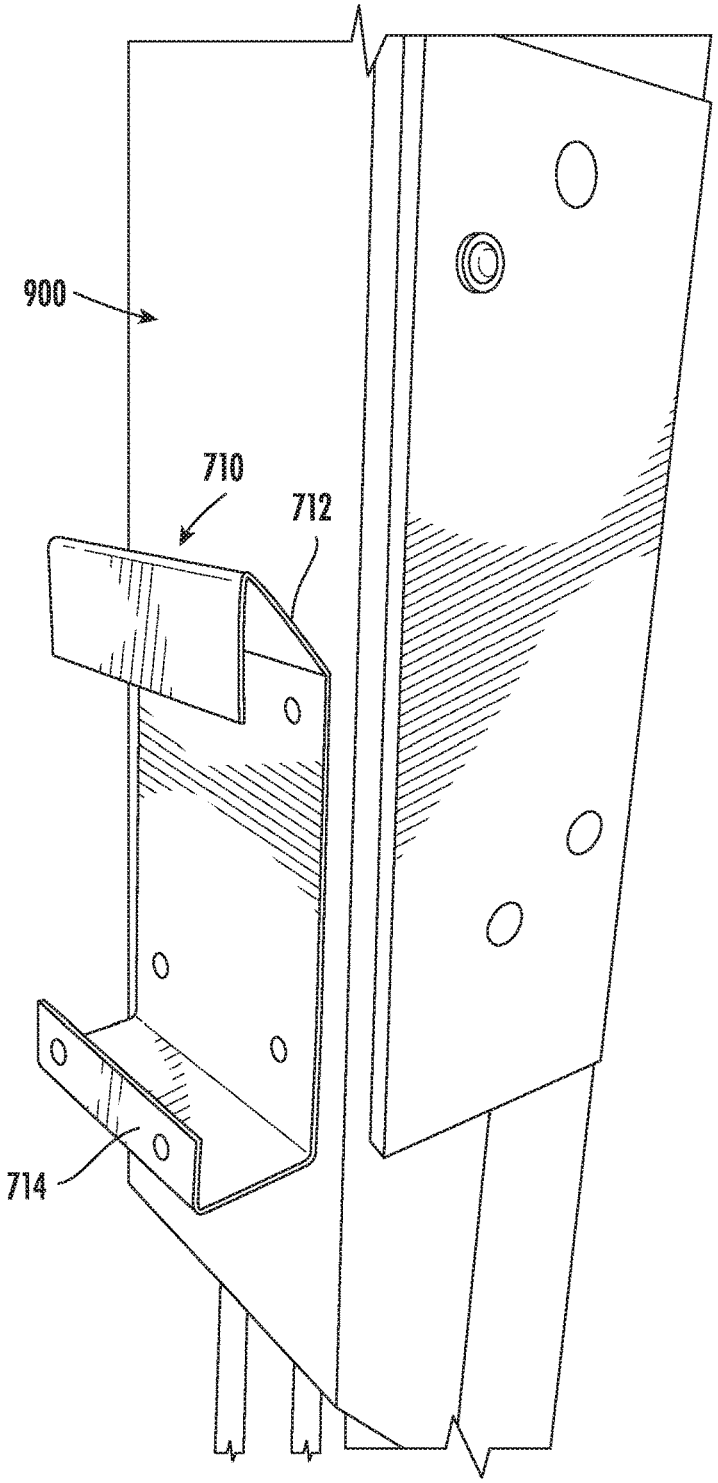
FIG. 11 illustrates an embodiment of an alternative bracket useful for creating the foundation of a structure using the height adjustable column assembly of the present disclosure.
Figure 12:
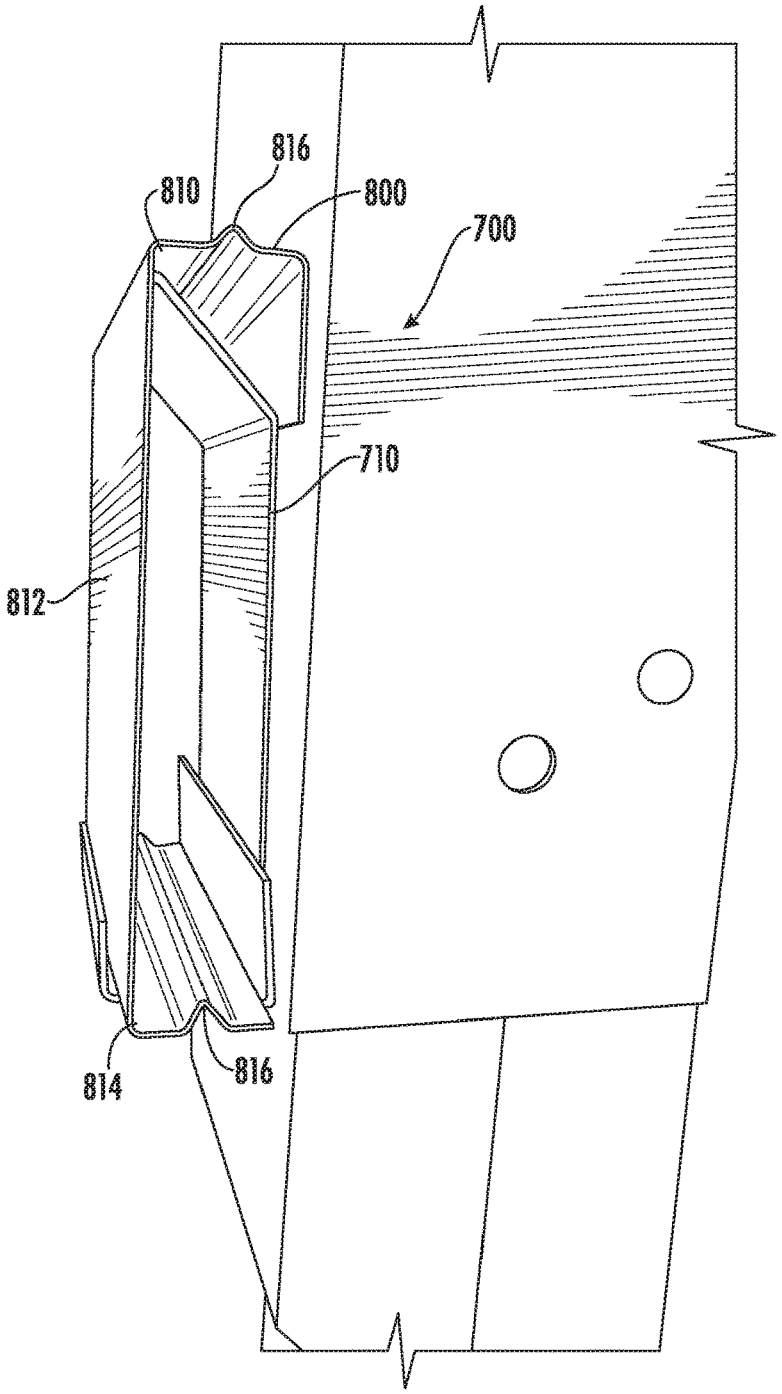
FIG. 12 illustrates a grade board engaged with the bracket of FIG. 11.
Figure 13:
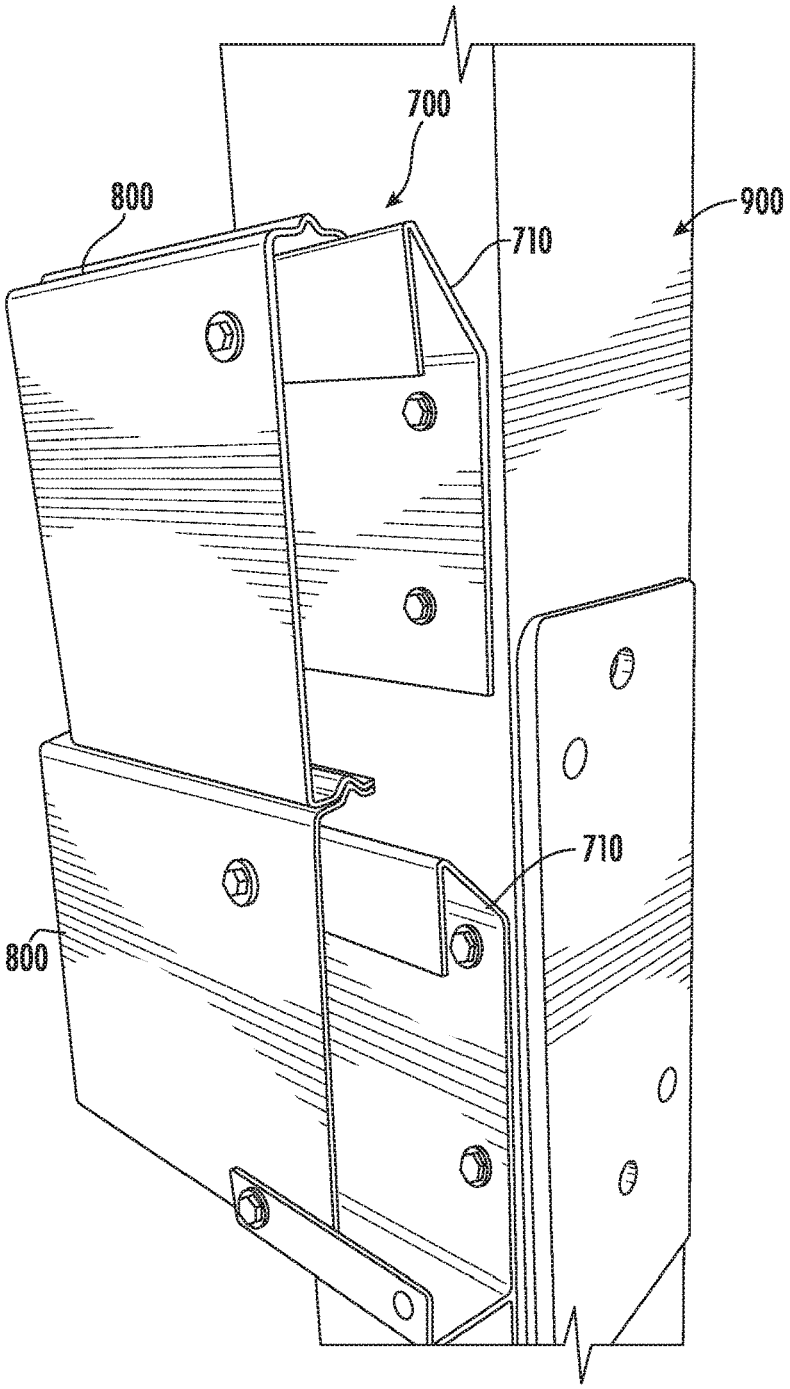
FIG. 13 illustrates another embodiment of the combination grade board and alternative bracket useful for creating a foundation of a structure using the height adjustable assembly of the present disclosure.
Figure 14:
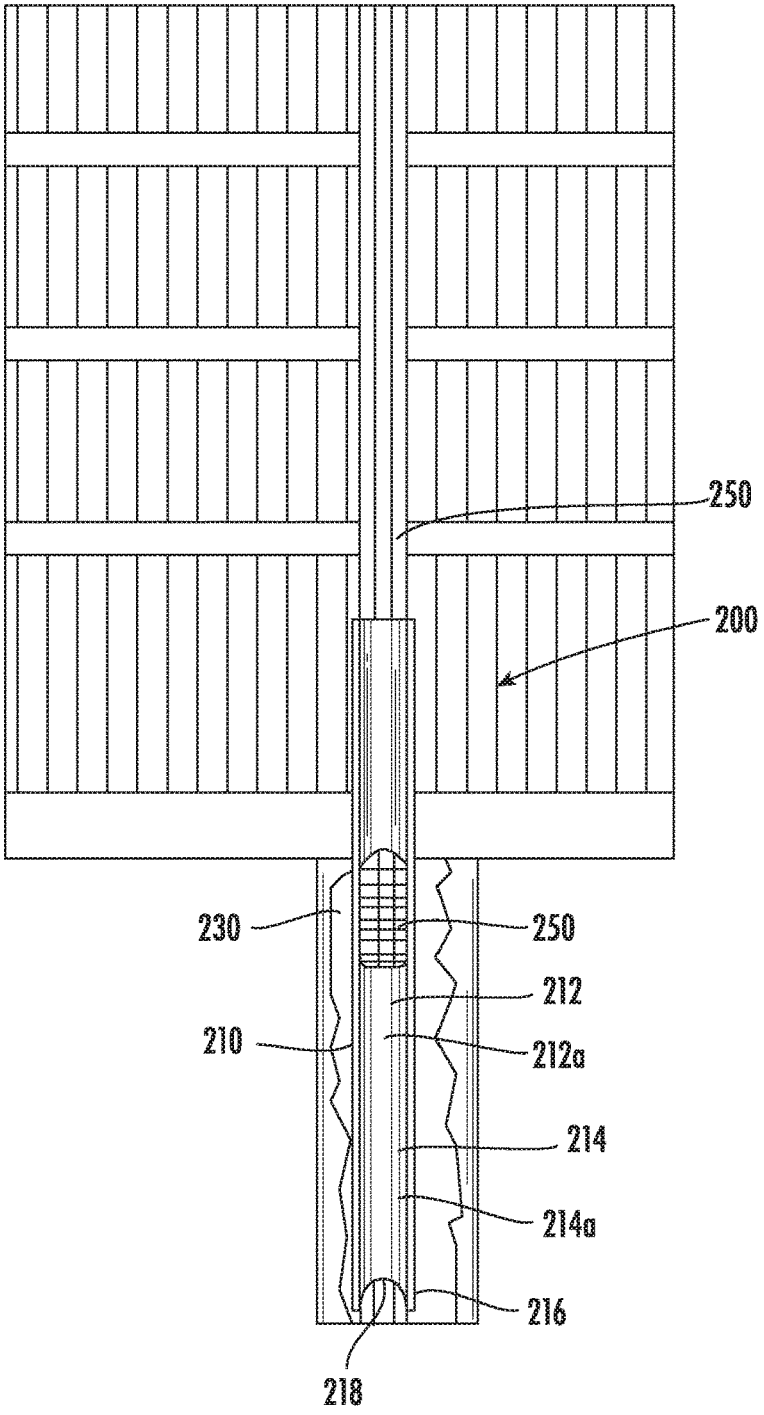
FIG. 14 illustrates an interior view of a post frame structure incorporating an embodiment of a reinforcement device, particularly a reinforcement sleeve according to the present disclosure.
Figures 15, 15A:
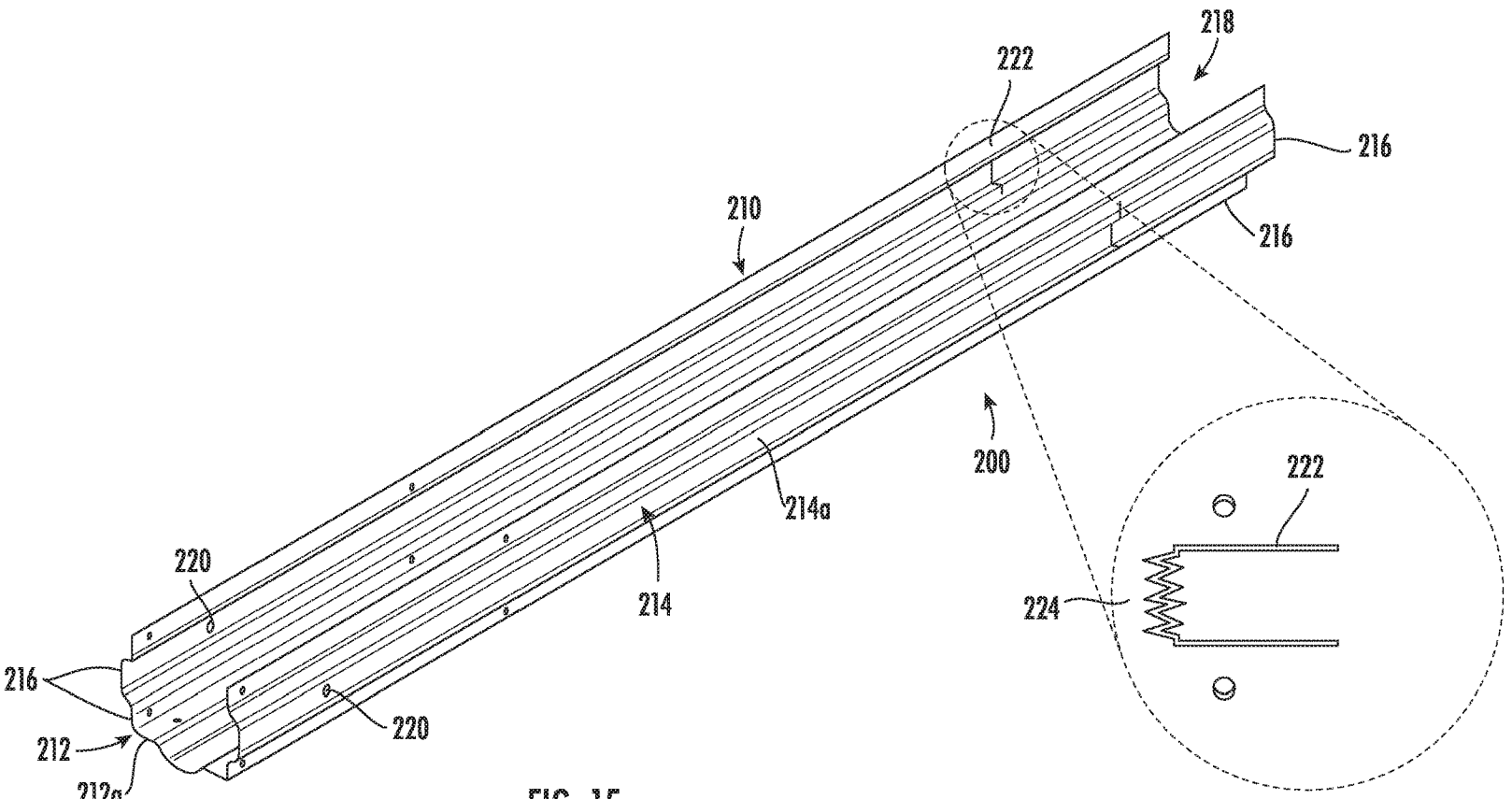
FIG. 15 illustrates a perspective view of an embodiment of a reinforcement sleeve according to the present disclosure.
FIG. 15*a* illustrates a close-up of an uplift tab found on the reinforcement sleeve shown in FIG. 15.
Figure 16:
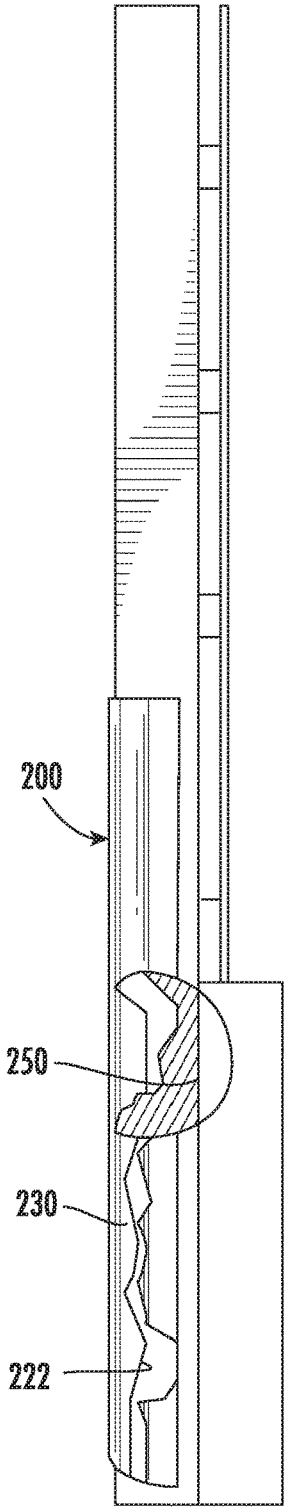
FIG. 16 illustrates the reinforcement sleeve according to the present disclosure positioned around a target column; and, FIG. 17 illustrates an interior view of a post frame structure incorporating an embodiment of a reinforcement sleeve according to the present disclosure.
Figure 17:
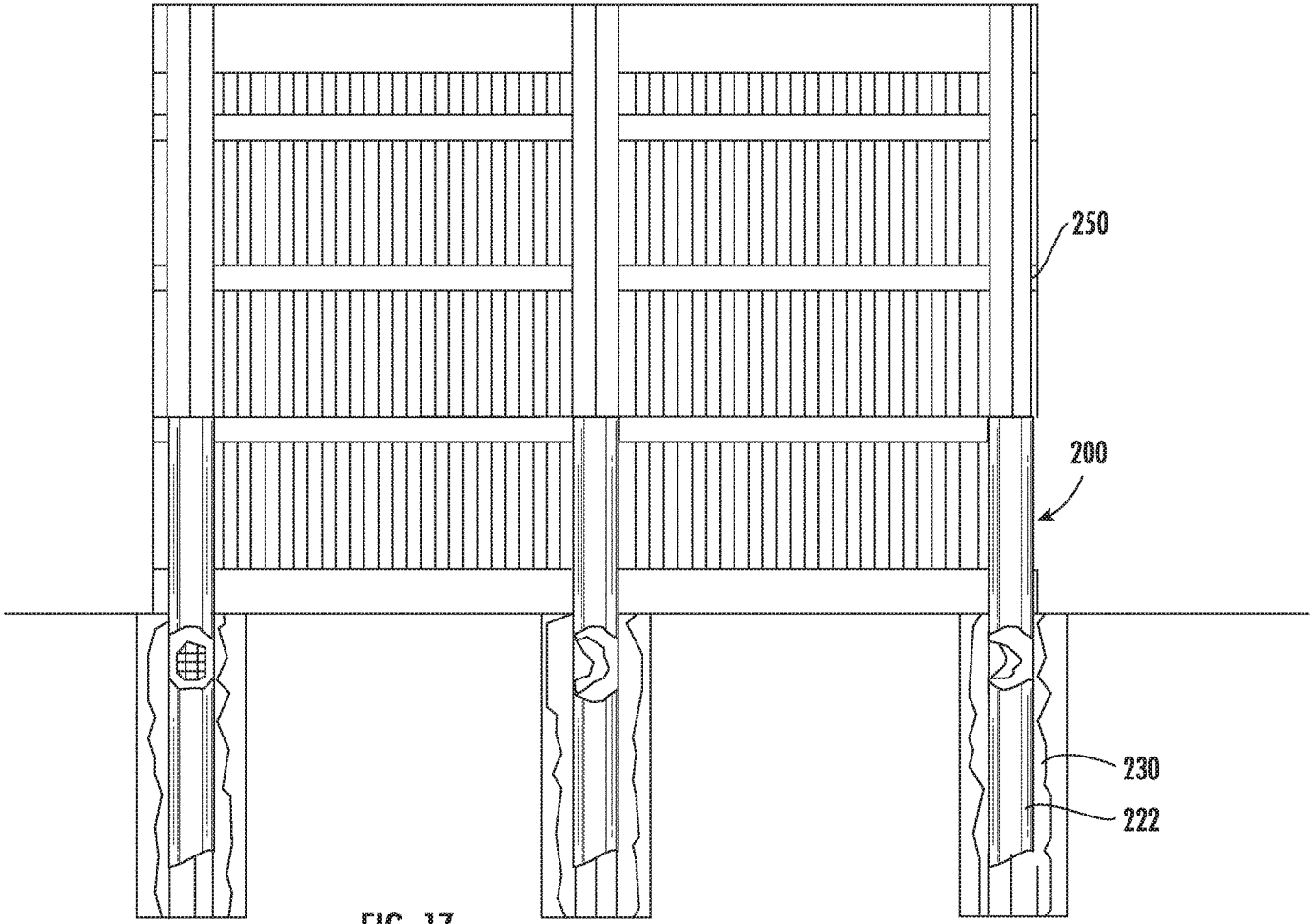

Now referring to the figures, wherein like numerals refer to like parts, FIGS. 1-4*a*-4*d* illustrate an embodiment of a reinforcement device 100, specifically, a height adjustable column assembly having a height adjustment mechanism therein. FIGS. 5-10 illustrate additional embodiments of a reinforcement device 300, 400, specifically a height adjustable column assembly using alternative versions of a height adjustment mechanism, respectively. FIGS. 11-13 illustrate a bracket and grade board combination useful in constructing the foundation for a structure. FIGS. 14-16 illustrate a reinforcement device, specifically a reinforcement sleeve useful for stabilizing and strengthening existing columns and/or posts of existing building structures, such as pole barns constructed from wooden posts. FIG. 17 illustrates an embodiment of the reinforcement device used for lifting an existing structure and increasing the interior space of the structure.

Creating a foundation for a structure, particularly a post-frame or pole barn structure 500, that is resistant to changing weather conditions, rot or decay, and insect-infestation, is vital for the long-term survival of the structure. Additionally, having options away from traditional wood and precast concrete as foundation supports is desirable to meet many of these requirements, and potentially reduce labor and equipment requirements and associated costs. As shown in FIGS. 1-3 and 4*a*-4*d*, an embodiment of a reinforcement device in the form of a height adjustable column assembly 100 incorporating an embodiment of a height adjustment mechanism 130 is provided for use in the construction of a structure 500. Alternative embodiments of height adjustment mechanisms 300, 400 incorporated into the height adjustable column assembly 100 are shown in FIGS. 5-10.

Figure 2:
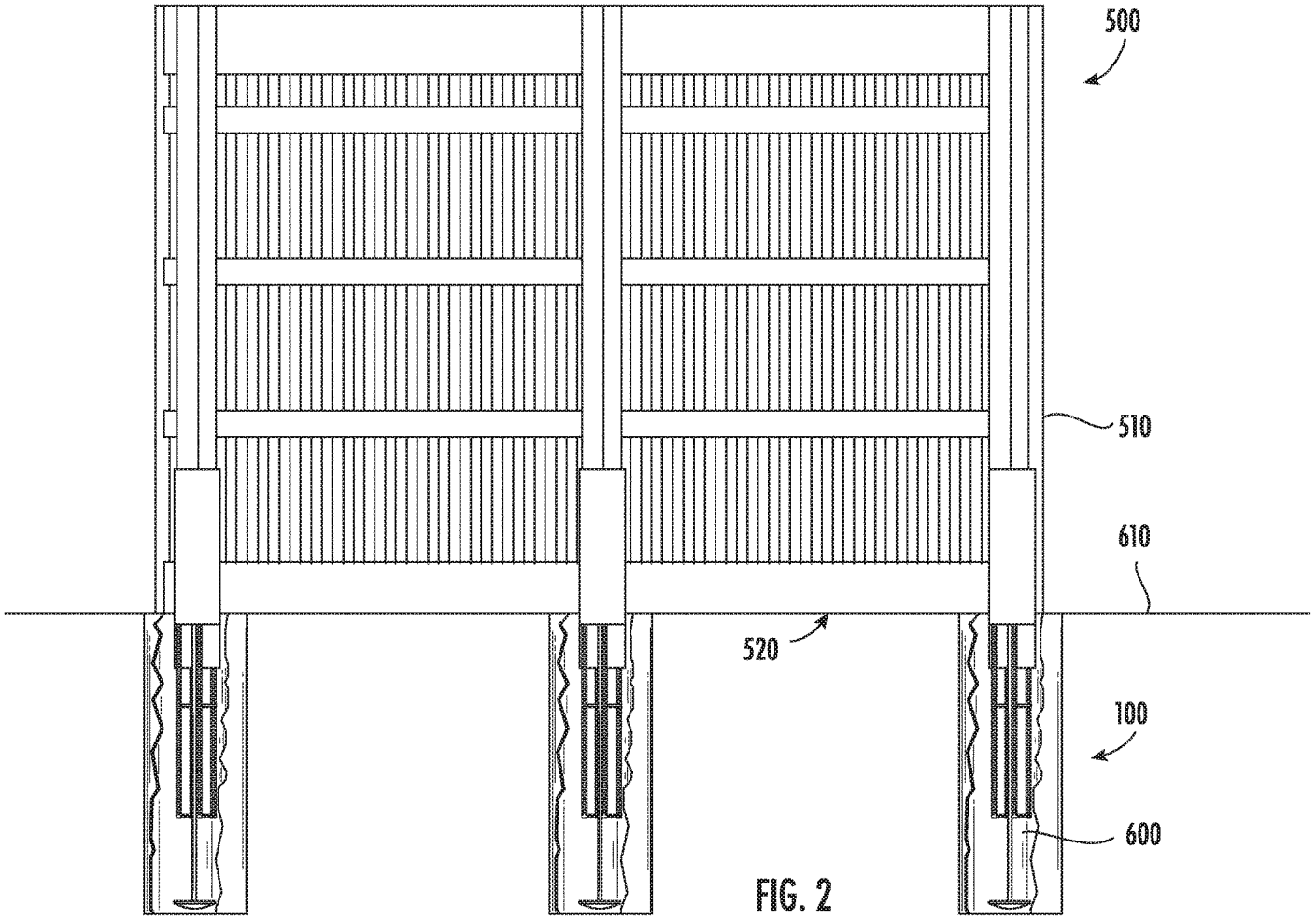
FIG. 2 illustrates a perspective view of the height adjustable column assembly in use with a post frame structure according to the present disclosure.

The height adjustable column assembly 100 includes a column body 102 having a top 104 and a bottom 106, a bracket 120, 128 at the top of the column body and a height adjustment mechanism 130. As shown in FIG. 2, when used as a foundation column for a structure 500, the column body 102 of the height adjustable column assembly 100 is placed within a hole 600 excavated in the ground 610 using known techniques to form the perimeter of the foundation 520 for a building structure 500. The bracket 120, 128 of the column assembly 100 remains at or slightly above ground level 610 for receiving and securing boards 505, also known as planks, grade boards or splashboards, which are secured to the height adjustable column assemblies to create the foundation 520 ultimately supporting the entire structure 500.

Figure 3:
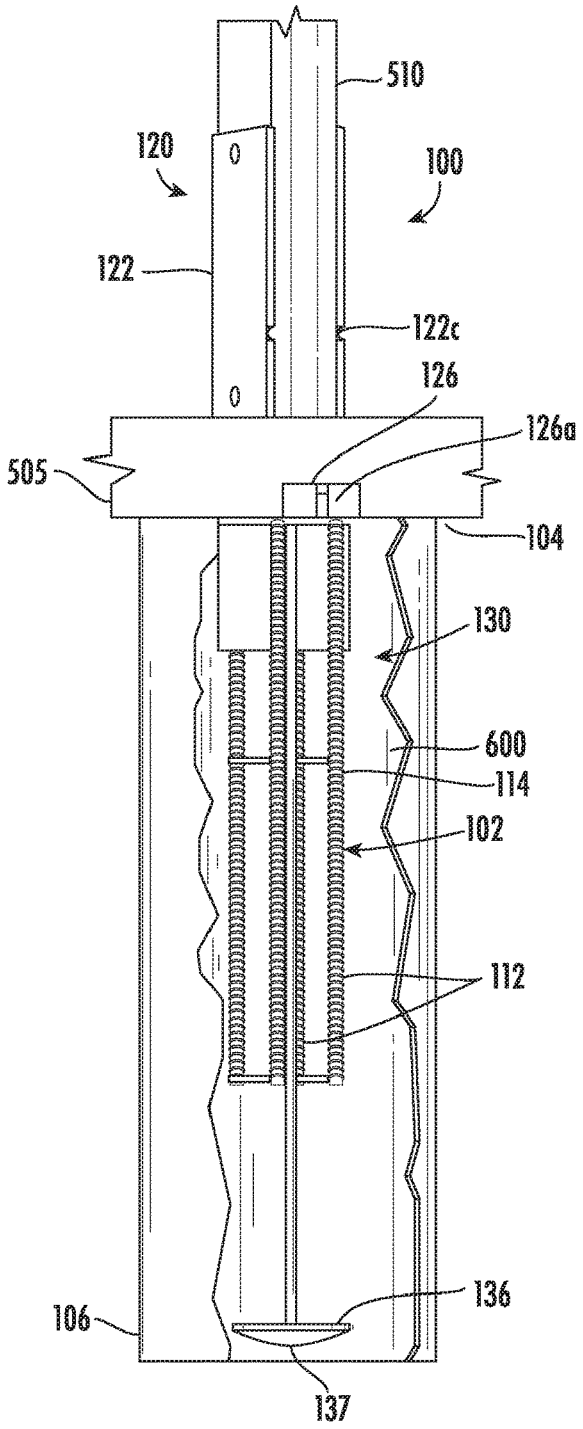
FIG. 3 illustrates an embodiment of the height adjustable column assembly according to the present disclosure.
Figure 4:
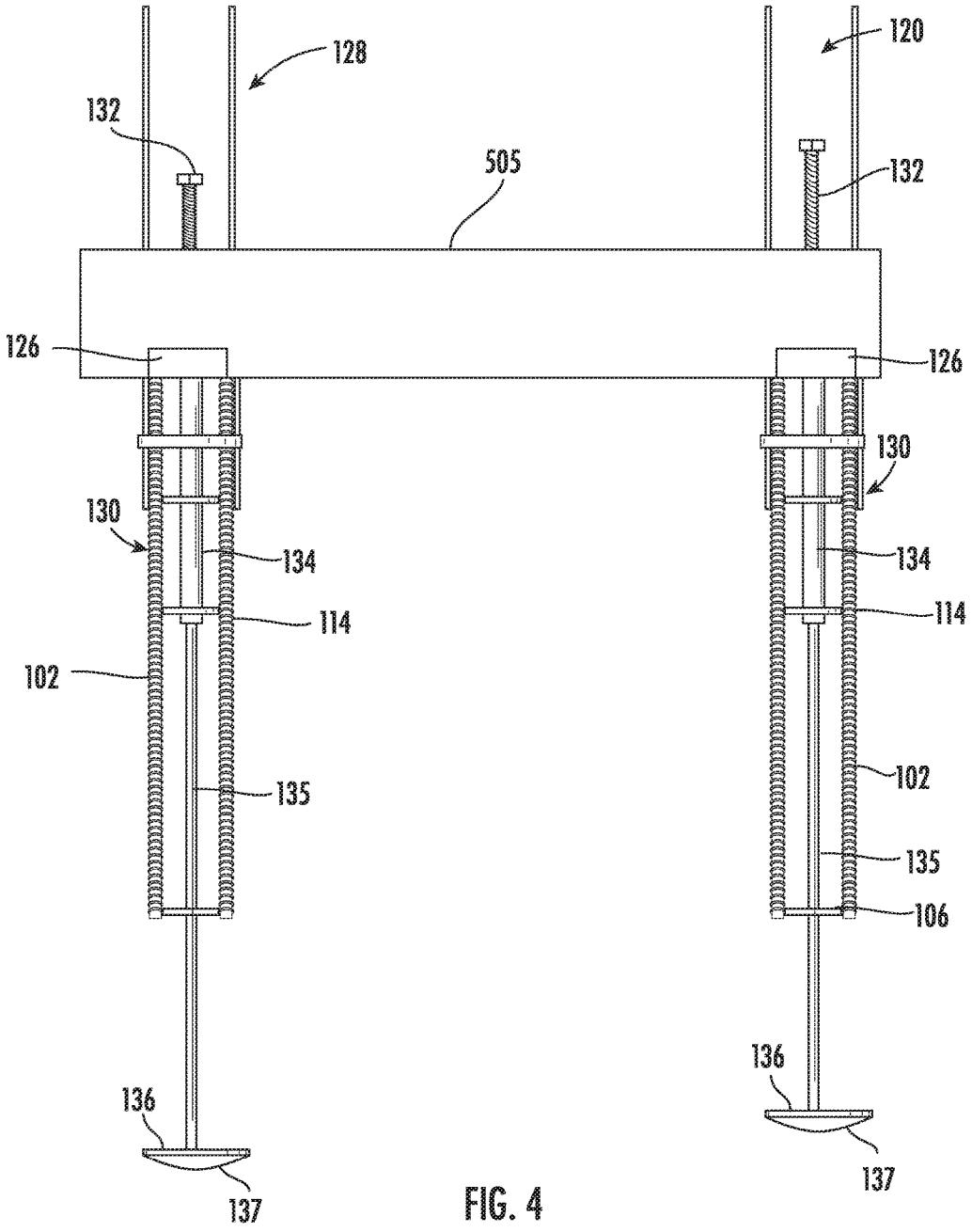
FIG. 4 illustrates an embodiment of the height adjustable column assembly according to the present disclosure supporting a board for a structure.
Figure 4A:
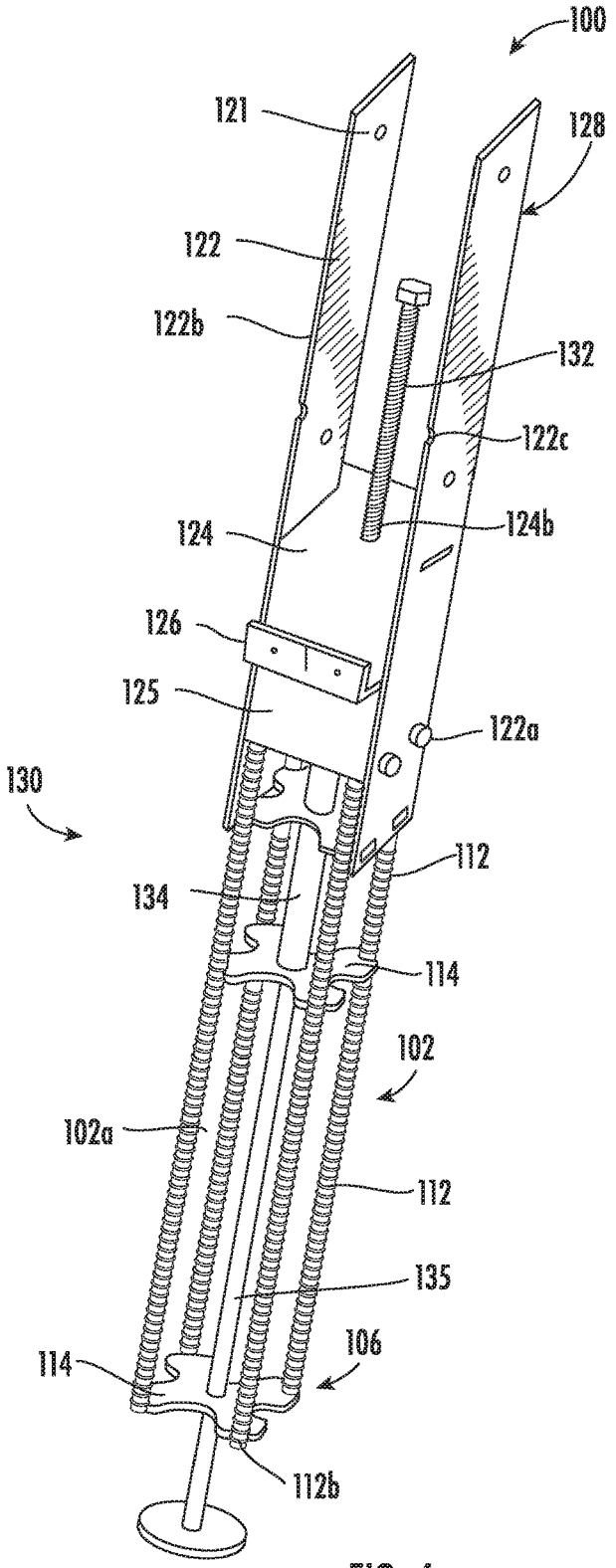
FIG. 4*a* illustrates a perspective view of an embodiment of a height adjustable column assembly according to the present disclosure.
Figure 4B:
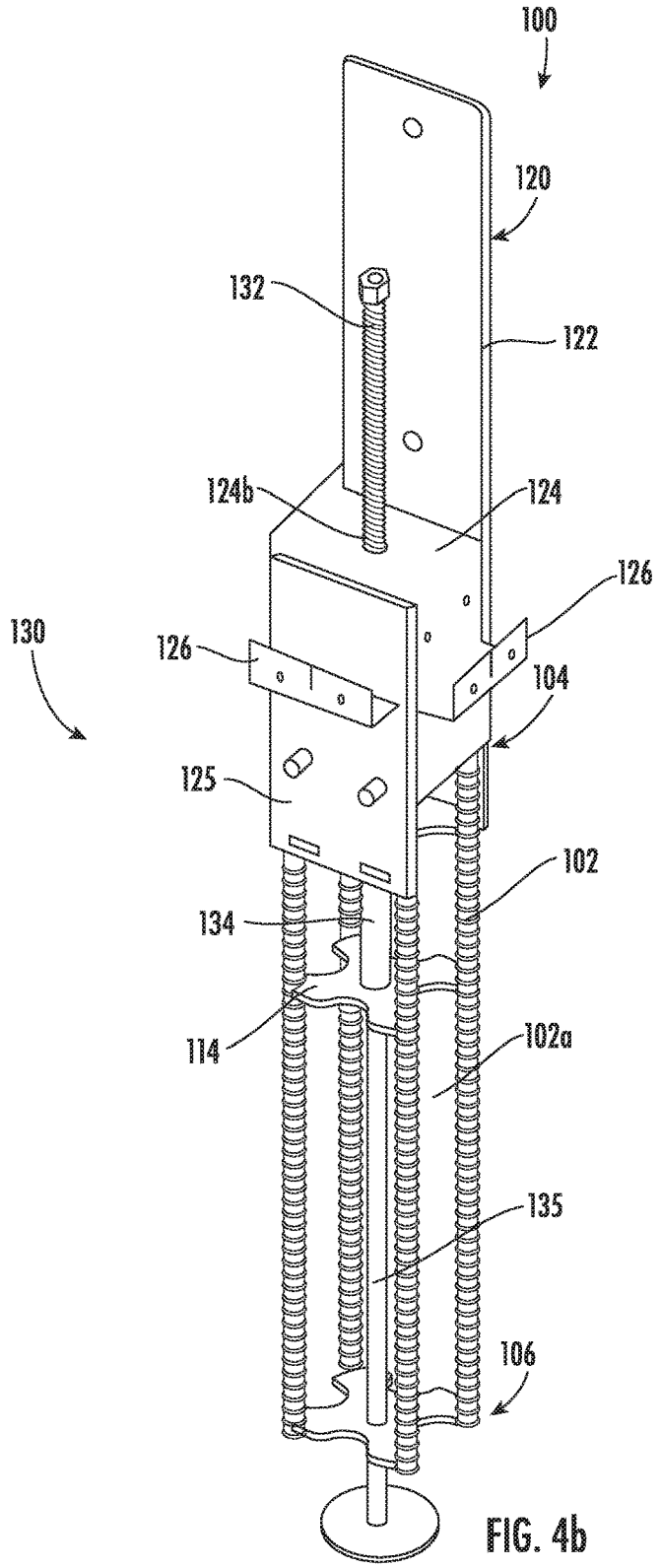
FIG. 4*b* illustrates a perspective view of an embodiment of a height adjustable column assembly for use as a corner support according to the present disclosure.
Figure 4C:
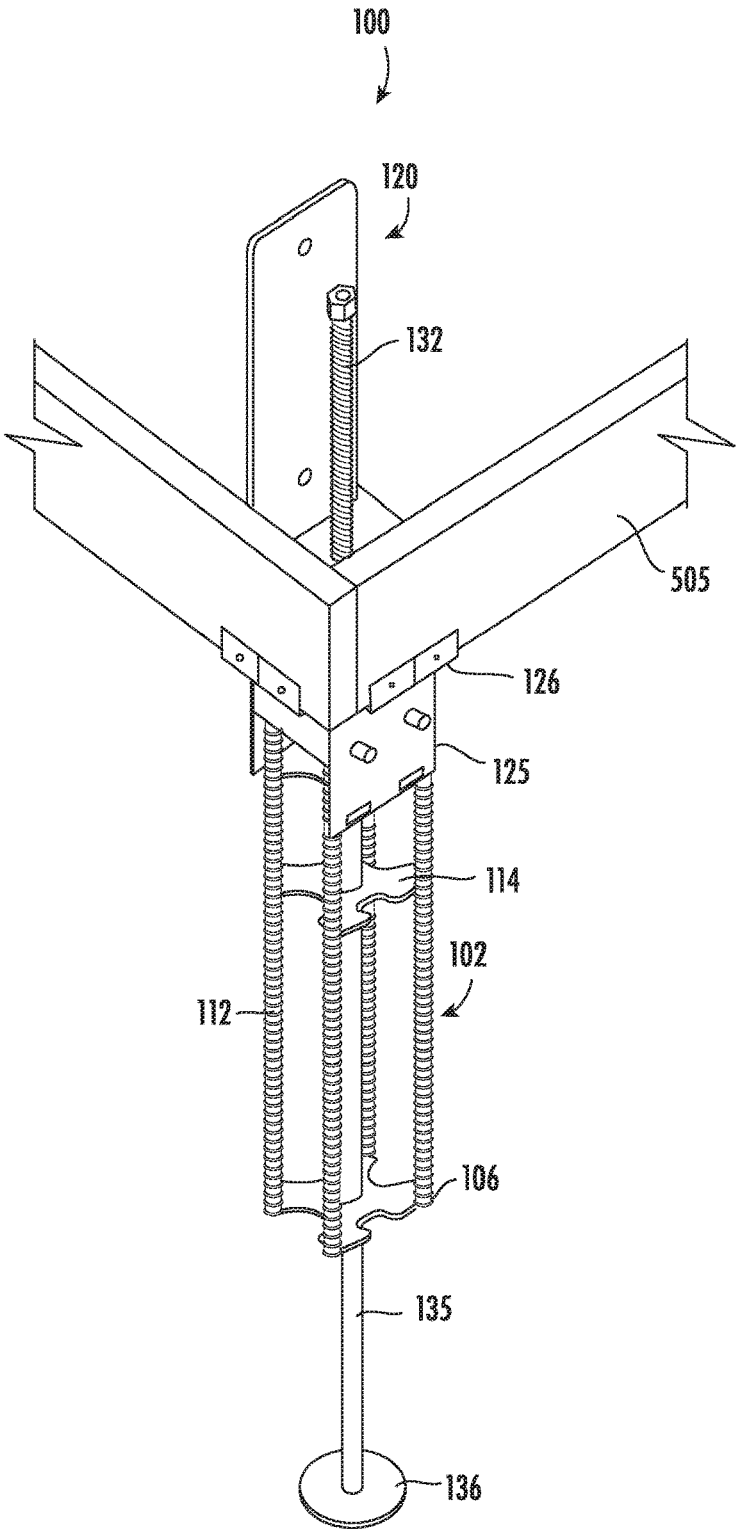
FIG. 4*c* illustrates a perspective view of the embodiment of a height adjustable column assembly for use as a corner support according to the present disclosure.
Figure 4D:
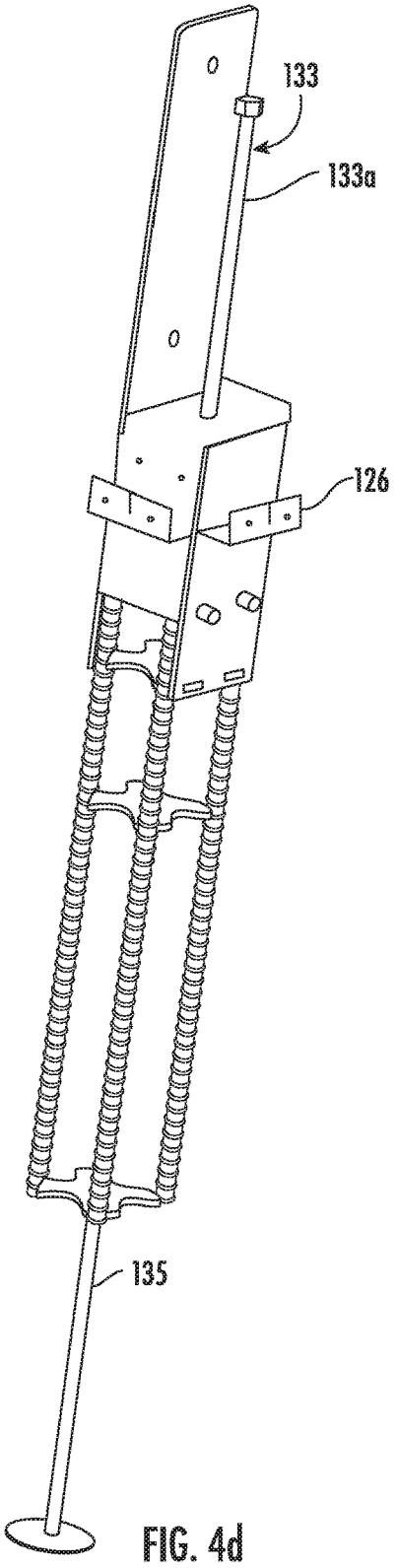
FIG. 4*d* illustrates a perspective view of an embodiment of a height adjustable column assembly incorporating another embodiment of a height adjustable mechanism.
Figure 5:
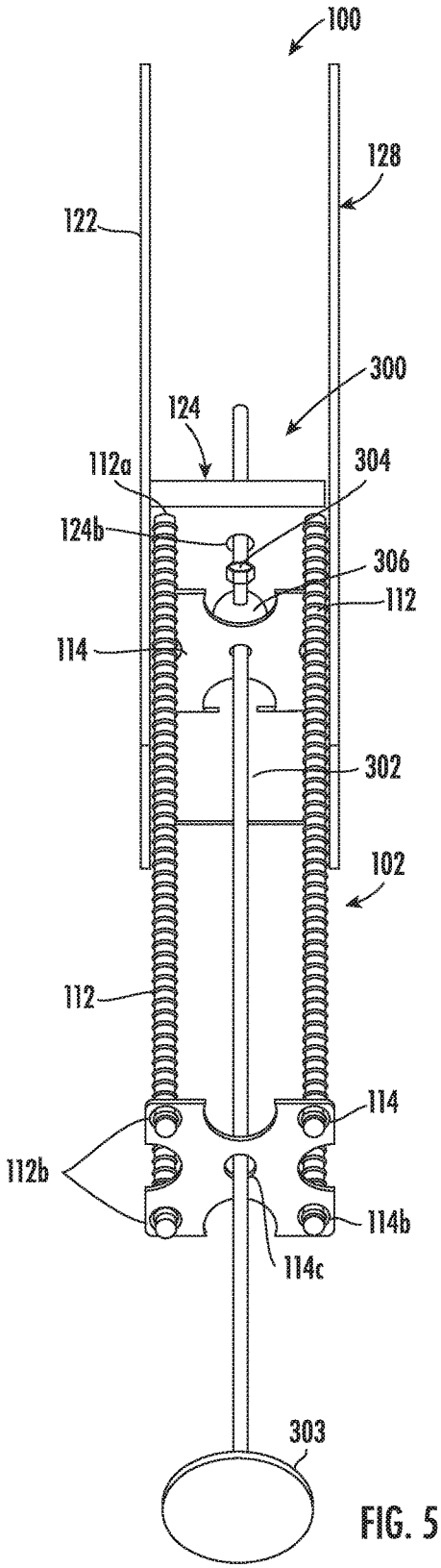
FIG. 5 illustrates an embodiment of a height adjustable column assembly according to the present disclosure, incorporating an alternative embodiment of a height adjustment mechanism.
Figure 8:
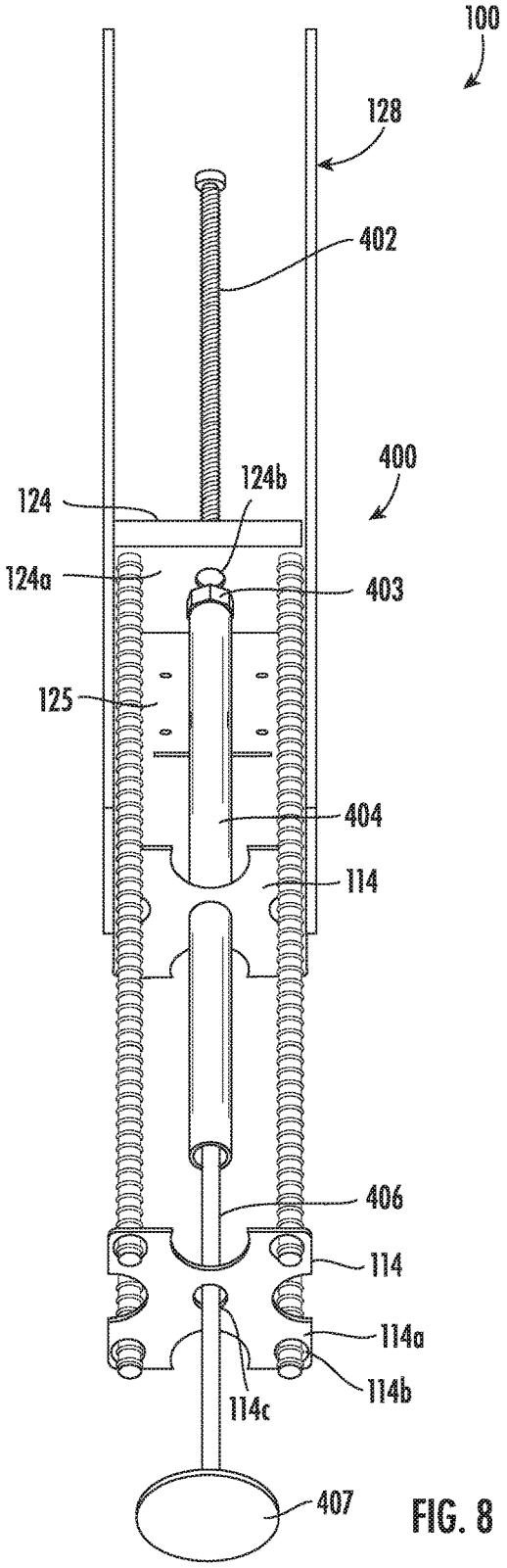
FIG. 8 illustrates a perspective view of a height adjustable column assembly according to the present disclosure, incorporating another alternative embodiment of a height adjustment mechanism.

As shown in FIGS. 3, 4 and 4*a*-4*d*, the column body 102 of the present height adjustable column assembly 100 is generally a cage formed from a plurality of reinforcing vertical bars 112, also referred to as "rebar," which form an outer perimeter of the cage of the column body 102, and an interior space 102*a* of the column body. For example, in one embodiment shown in FIGS. 4*a* and 4*b*, four, evenly-spaced vertical bars 112 form a generally rectangular cage of the column 102. The top end 112*a* of the vertical bars 112 are welded directly to the underside or undersurface 124*a* of the base 124 of the bracket 120, 128 (FIG. 4*c*, FIG. 5 and FIG. 8). The opposing bottom end 112*b* of the vertical bars is secured typically by welding to a reinforcement anchor 114 at the bottom 106 of the column body 102 (FIG. 4*a*). It should be understood that although four vertical bars 112 are shown, any number of vertical bars may be used to create the cage structure of the column body 102.

The column body 102 is further strengthened and stabilized by at least one reinforcement anchor 114, which horizontally spans the interior space 102*a* inside the perimeter of the cage. The reinforcement anchor 114 has generally an X-shape, where each leg 114*a* of the anchor is rigidly connected, such as by welding, to each of the vertical bars 112. Alternatively, the individual vertical bars 112 of the column body 102 may engage openings 114*b* in the legs 114*a* of the anchor, where the bars can be secured, also by welding (FIGS. 4*a*-4*d*, 5, 6, 8 and 9). The reinforcement anchor 114 further includes a center opening 114*c* for receiving components of the height adjustment mechanism, for example, the guide tube or cylinder 134, and the extension rod 135 (FIGS. 4*a* and 8). The reinforcement anchor 114 acts as a brace providing additional strength to vertical bars 112 forming the column body 102 and stabilizes the components of the height adjustment mechanism 130 within the interior of the column body. The reinforcement anchors 114 assist to maintain the integrity of the column body 102 and height adjustment mechanism 130 components as the column body is surrounded by dirt, gravel or concrete after the column assembly 100 is placed in the ground and initially leveled. Although the figures illustrate embodiments with varying numbers of reinforcement anchors 114 positioned in a number of different locations within the column body 102, it should be understood that any number of reinforcement anchors 114 may be incorporated, as well as positioned at various points within the column body 102, including at or near the bottom 106 of the column body, and in any location between the bottom and the bracket 120.

The top 104 of the column body 102 includes a bracket 120, 128. The bracket 120, 128 is designed to receive and secure boards 505, such as the splashboards, grade boards or planks to create the foundation 520 of a building 500, as well as, receive and secure vertical columns 510 used for constructing the walls of the building (FIGS. 3 and 4). As shown in detail in FIGS. 4*a* and 4*b*, there are at least two embodiments for the brackets 120, 128, depending on whether the bracket is a corner bracket 120, or a side bracket 128. The corner bracket 120 includes at least one upright arm 122 connected to a horizontal plate forming a base 124 (FIG. 4*b*). The side bracket 128 includes two opposing upright arms 122 connected by the base 124, essentially forming a U-shape or H-shape bracket (FIG. 4*a*). Lower sections 122*a* of the arms 122 are connected, generally by welding, to the vertical bars 112 forming the column body 102, while upper sections 122*b* of the arms include a plurality of holes 121 for receiving fastening devices for securing the boards and vertical columns placed between the opposing arms.

Each upright arm 122 further includes a notch 122*c* on an outer edge of the upper section 122*b* of each arm, the notch adapted for receiving, squaring and levelling a string (not shown) useful in determining the overall squareness and level position of a plurality of the column assemblies 100 after placement of the assemblies in respective holes 600 forming the initial perimeter of the building 500 (FIG. 2). The designated use of the height adjustable column assembly 100, as either a side wall column 128 (FIG. 4*a*) for use in the construction of a long side of the proposed building, or as a corner column 120 (FIG. 4*b*) for use in the joining of a corner of the propose building, dictates which embodiment of the bracket 120, 128 is needed.

As shown in FIGS. 4*a* and 4*b*, the bracket 128 includes a vertical plate 125 extending downward from the base. The vertical plate 125 further extends and connects between a lower section 122*a* of the opposing arms 122 (FIG. 4*a*). At least one integrated side support bracket 126 is disposed on the vertical plate 125 at the base of the bracket. Optionally, two side support brackets 126 arranged, one on each perpendicular connecting side of the base 124 of the bracket, are used for corner placement of boards on the corner bracket 120 (FIGS. 4*b* and 4*c*). The side support bracket 126 is designed to receive a board 505, grade board, splash board or plank, which is used to build the foundation 520 of the building (FIGS. 3, 4 and 4*c*). Side support bracket 126 may include a vertical centerline in the form of a slot 126*a* used for accurate measurement of column spacing (typically about 8 feet apart) allowing precise placement of building columns when setting out the perimeter of the building 500 (FIGS. 4*a*, 4*b*).

Figure 1:
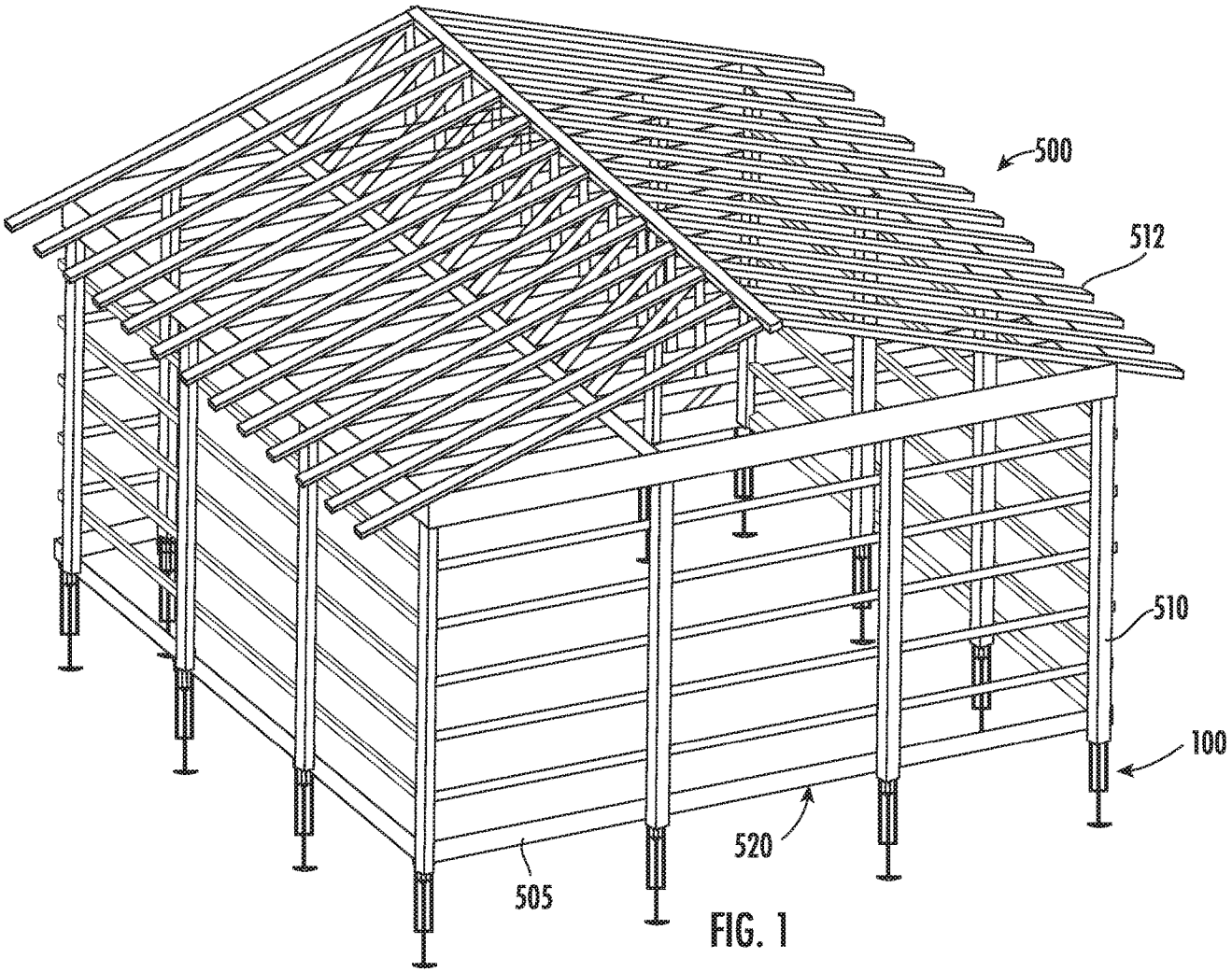
FIG. 1 illustrates a perspective view of a post frame structure incorporating an embodiment of a reinforcement device, particularly a height adjustable column assembly according to the present disclosure.

During construction of a new building, after multiple adjustable column assemblies 100 are placed in each of the respective excavated holes 600 around the proposed perimeter of a building, the side support bracket 126 or brackets of each column assembly 100 engage a board 505, spanning across each of the assemblies (FIG. 4) to begin building the foundation 520. The column assemblies 100 are leveled through placement of a leveling string (not shown) along each notch 122*c* on the outer edge of each upright arm 122. A laser level (not shown) is used in conjunction with the leveling string after it is placed in the notch 122*c* to assist in accurately leveling each of the column assemblies 100 after placement. Because each grade board 505 interlocks within the side support bracket 126 of the column assembly 100 thereby providing lateral support, the entire foundation system is stabilized and no post movement occurs when installing structural columns 510 for ultimately supporting trusses 512 of the structure 500 (FIG. 1). The combination of the side support brackets 126 with the grade boards 505 keeps each of column assemblies 100 in position in the excavated hole 600 before the hole is filled with concrete and secured.

FIG. 4 illustrates one embodiment of a height adjustment mechanism 130 for use in the height adjustable column assembly 100. In this embodiment, the height adjustment mechanism 130 is a three component assembly, including: a rod 132; a hollow guide tube or cylinder 134 disposed vertically from and connected to an undersurface 124*a* of the base 124 of the bracket 120, 128; and an extension rod 135. The rod 132 may have a threaded outer surface 132*a* (FIGS. 4*a-c*). Optionally in another embodiment, the rod 133 may have a smooth outer surface 133*a* without threading (FIG. 4*d*). The rod 132 passes through a central opening 124*b* in the base 124 of the bracket 120, 128, entering into the interior space of the guide tube or cylinder 134, which is positioned in line with the opening in the base. The guide tube 134 can have any length, but it is typically about one third to one half the length of the column body 102. The guide tube or cylinder 134 includes a threaded nut (not shown, but see reference number 403 in FIG. 8) welded at the top of the guide tube where the tube connects to the undersurface 124*a* of the base 124 of the bracket 120, 128. As the rod 132 passes through the opening 124*b* in the base, the threaded outer surface 132*a* of the rod 132 engages with the threaded nut on the top end of the guide tube 134. Optionally, in another embodiment, rather than a threaded nut at the top of the cylinder 134, the interior surface of the guide tube 134 itself is threaded for engagement with the threaded surface 132*a* of the first rod 132. In yet another embodiment, the rod 133 has a smooth, non-threaded outer surface 133*a*, and guide tube 134, without either the threaded nut or a threaded inner surface, simply telescope together for engagement with the second extension rod 135 (FIG. 4*d*).

The third component of height adjustment mechanism 130, the extension rod 135, is generally a smooth rod having a diameter smaller than that of the guide tube 134, that is positioned upward through the bottom 106 of the column body 102 and into the interior of the guide tube 134. The extension rod 135 includes disk-shaped base or foot plate 136 at the bottom of the rod and outside of the column body 102 (FIG. 4). The extension rod 135 further passes through a center opening 114*c* of at least one reinforcement anchor 114, which assists in stabilizing and holding the extension rod in position. The foot plate 136 may be flat or include an angled bottom, which is configured to engage the floor of an excavated hole, thereby providing resistance when the height adjustment mechanism 130 is engaged to vertically move the column assembly 100.

The present height adjustment mechanism 130 is an improvement and an advantage over other mechanisms in standard foundation columns because it provides the option to adjust the adjustable column assembly 100 on a construction site, with precision, while the assembly is in an upright position and already placed within an excavated hole 600. Rough height adjustments can be made prior to installation of the adjustable column assembly 100 into the excavated hole 600; however final, finessed adjustments can be made through the height adjustment mechanism 130, even after wet cement is added to the hole.

Specifically, operation of the present height adjustment mechanism 130 includes the rod 132 passing through the opening 124*b* in the base 124 of the respective bracket 120, 128 for engagement with the guide tube 134, either through the threaded nut disposed at the top of the guide tube, or through engagement with a threaded interior surface of the guide tube, or, optionally, through non-threaded telescoping engagement between the rod and the guide tube. In one example, using an appropriate tool, such as a screw gun, the rod 132 is rotated downward into the threaded nut 134*a* of the guide tube 134 until it engages with the extension rod 135, which is positioned upward into the interior space of the guide tube 134. By rotating or pushing the rod 132 downward into the guide tube, and against the extension rod 135, the column assembly 100 can be precisely adjusted, up or down, after placement of the column assembly into the excavated hole 600. Because the guide tube 134 surrounds and protects the rod 132 and extension rod 135 as they connect inside the guide tube from contact with dirt or cement as it is placed within the hole 600 around the column assembly 100, the height adjustment mechanism 130 can adjust the height of the column assembly even after concrete is poured within the hole and while still wet. After the appropriate adjustments are complete, the rod 132 can then either be removed or cut, and a vertical column 510 for construction of a structure can be secured in the bracket 120 using known fasteners (FIG. 3). Thus, the height adjustment mechanism 130 is useful to accommodate post holes of inconsistent depths and levels, because it permits custom, on-site levelling of the foundation boards 505, even after surrounding the column assembly with dirt, gravel, concrete or any other securing material.

Figure 6:
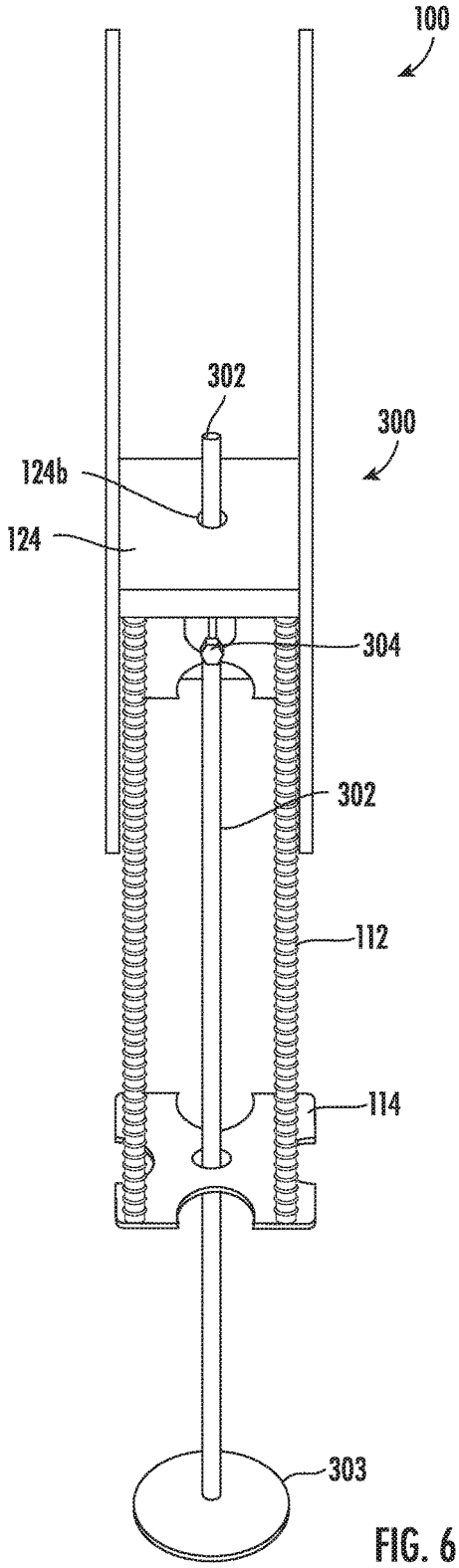
FIG. 6 illustrates the embodiment of the height adjustable column assembly according to the present disclosure, incorporating the alternative embodiment of the height adjustment mechanism in FIG. 5.
Figure 7:
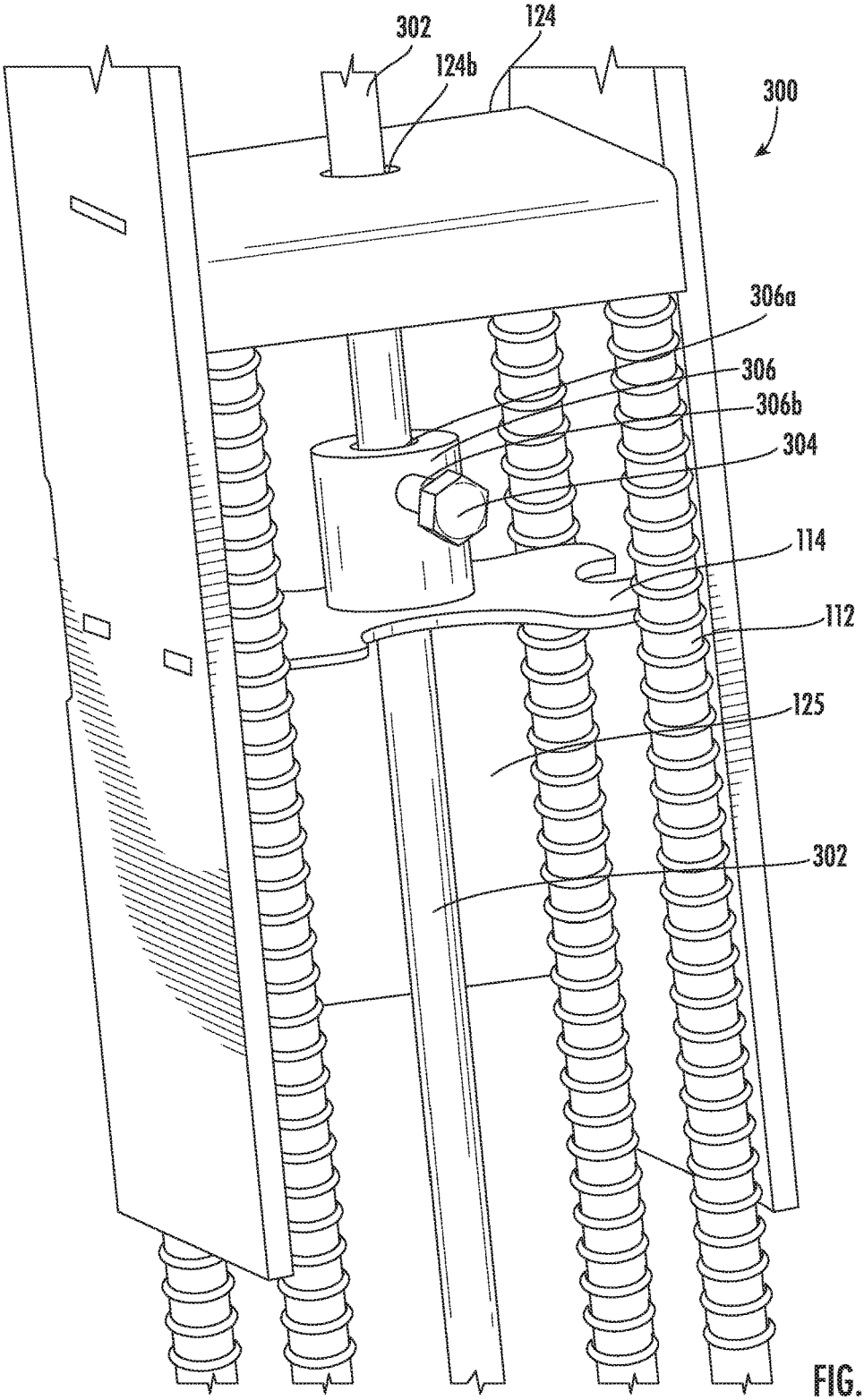
FIG. 7 illustrates a close-up view of the height adjustment mechanism used in the height adjustable column assembly of FIGS. 5 and 6.

FIGS. 5-7 illustrate another embodiment of a height adjustment mechanism 300 useful in the present column assembly 100. Specifically, in this embodiment, the height adjustment mechanism 300 includes a single rod 302, which passes through an opening 124*a* centered in the top of the bracket 128, as previously described, through interior space 102*a* of the column body 102, the rod ending in a foot plate 303. At least one reinforcement anchor 114 is positioned within the column body 102, such that the single rod 302 passed through the center opening 114*a* of the reinforcement anchor 114 or anchors located within the column body 102. A set screw 304 and collar 306 combination are positioned below the base 124 of the bracket, the collar having a center opening 306 such that the single rod is vertically slidably within the collar. The set screw 304 is configured for threaded engagement with a side opening 306*b* within the collar 306. It should be noted the positioning of the set screw 304 and collar 306 combination can be anywhere along the length of the column body 102; however, higher placement of the set screw and collar within the column body may provide more convenient access for adjustment once the column assembly 100 is placed within a hole. Additionally, a reinforcement structure, such as a reinforcement anchor 114, or other form of reinforcement bar can be positioned below the set screw and collar combination, for additional security. After the column assembly 100 is placed within a hole, the height of the column assembly can be made by sliding the assembly up and down along the rod 302, which has a smooth outer surface. Optionally, the outer surface of the rod 302 may be textured for engagement with the set screw 304. Once the desired height is reached, the column assembly 100 can be locked into position by tightening the set screw 304 against the rod 302. This embodiment of the height adjustment mechanism 300 provides easy manual adjustment and setting of the height of the column assembly, eliminating the need for additional tools and equipment.

Figure 9:
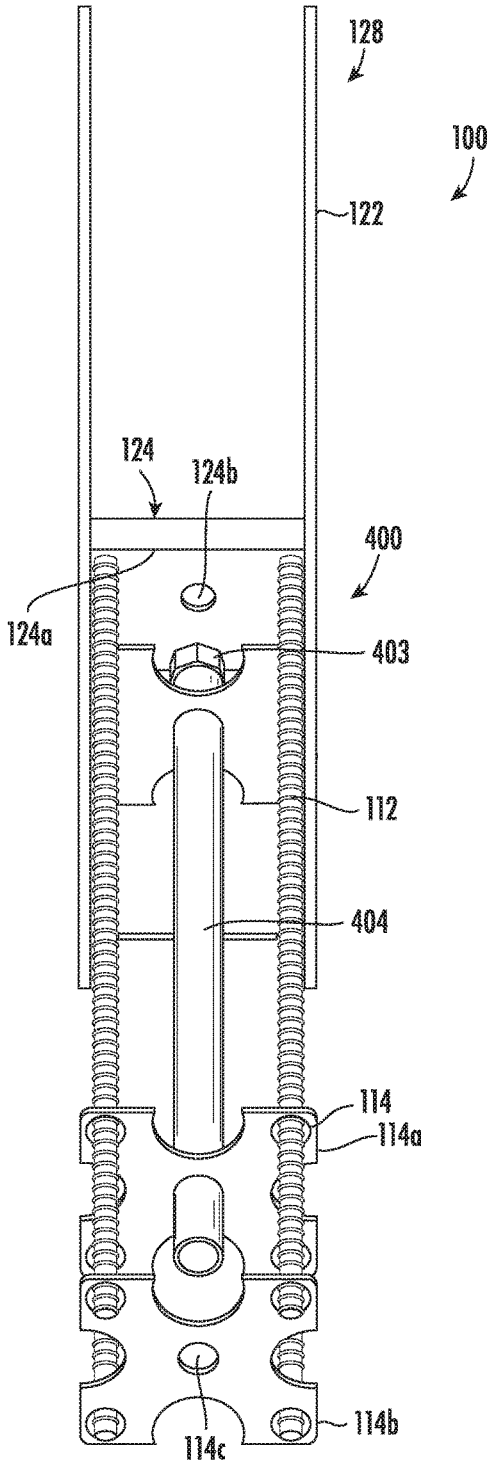
FIG. 9 illustrates a perspective view of the height adjustable column assembly of FIG. 8, incorporating the alternative height adjustment mechanism.
Figure 10:
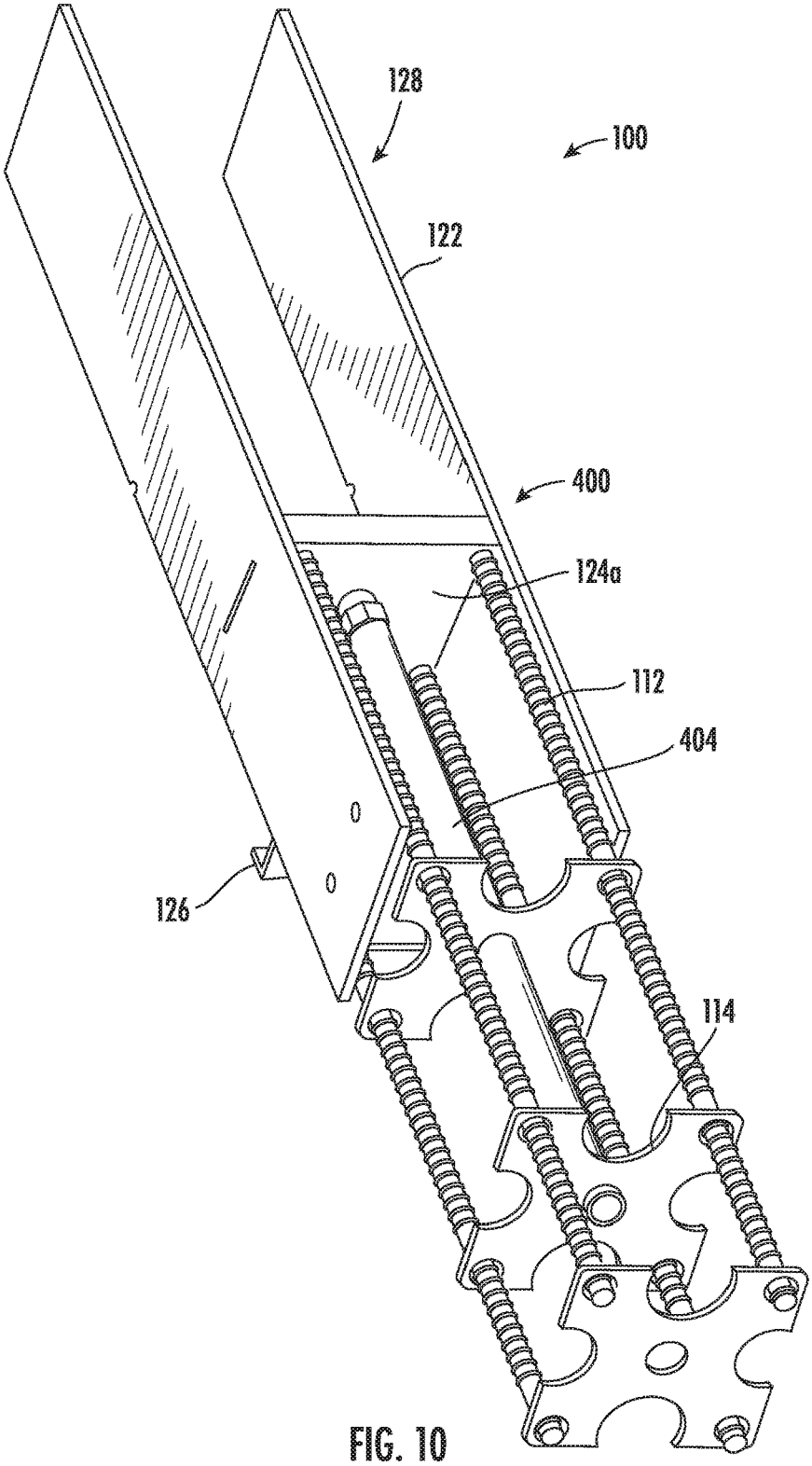
FIG. 10 illustrates a perspective view of the height adjustable column assembly of FIG. 8, incorporating the alternative height adjustment mechanism.

FIGS. 8-9 show yet another embodiment of a height adjustment mechanism 400 useful in the present column assembly 100. Similar to the height adjustment mechanism 130 described above, this embodiment of the height adjustment mechanism 400 is a three component assembly, including a first rod 402, a hollow cylinder 404 disposed vertically within the interior of the column body 102, and an extension rod 406. As shown in FIGS. 8 and 9, the cylinder 404, is positioned away from, and not connected directly to the bottom or undersurface 124*a* of the base 124 of the bracket 128. In this embodiment, a threaded nut 403 is at the top of the cylinder 404, which is used for engagement with a threaded outer surface of the first rod 402, as previously described. Alternatively, rather than including a threaded nut 403 at the top of the cylinder 404, the interior or inner surface of the cylinder 404 could be threaded for engagement with the threaded surface of the first rod 402.

This height adjustment mechanism 400 functions in a similar manner to adjust the height of the column assembly 100 as the previously-described height adjustment mechanism 130. The first rod 402 passes through an center opening 124*b* in the base 124, where it enters the interior space of the cylinder 404. With its foot plate 407 at ground level in a hole, the extension rod 406 passes upward through the bottom 106 of the column body 102, and into the interior space of the cylinder, where it meets with the first rod 402. As the first rod 402 rotates and pushes against the extension rod 406, the vertical height of the column assembly 100 can be adjusted up or down to the desired position. As previously described, any number and positioning of reinforcement anchors 114 are provided within the interior 102*b* of the column body 102.

The present height adjustable column assembly 100 is designed to replace the standard wood, concrete, or combination of both, traditionally used as foundation columns in post-frame or pole barn construction. Constructed from any suitable corrosion-resistant material, such as galvanized steel powder coat or plated materials, the present height adjustable column assembly 100 is light-weight (weighing less than 40 pounds) making easily maneuverable and adjustable for placement within an excavated hole 600, without the need to additional tools or equipment. However, and unlike traditional wooden posts, which can rot and potentially fail, the present column assembly 100 is not susceptible to the elements or insect infestation, nor will the present column assembly expand and contract due to freezing and thawing. Additionally, and unlike traditional precast concrete columns, which are heavy and hard to maneuver once set in place, the light-weight construction of the present column assembly 100 allows for easy placement and adjustability, particularly in view of any one of the height adjustment mechanism assemblies 130, 300, 400 described above. Concrete columns as well can be susceptible to cracking and water damage, which can again jeopardize the overall stability of a structure, and thus are not ideal for use as foundation supports.

Installation of the present height adjustable column assembly 100 in the construction of a post-frame building 500 is significantly easier than traditional foundation systems. Initially, a series of holes 600 are dug using known methods (for example, manually or using an auger) to create the intended perimeter of the building 500. A separate height adjustable column assembly 100 is set, generally by hand by one or two persons, into each hole 600 (FIG. 2). Each height adjustable column assembly 100 comes preassembled, and the pre-drilled holes 121 in various positions along the length of the arms 122 of the brackets 120, 128 make for simple attachment of grade boards, planks or splash boards set into the side support brackets 126 of the column assembly. The present column assembly 100 is much lighter than traditional wooden posts and concrete posts, making lifting and placing the column assemblies safer and easier, as well as, reducing or even eliminating the need for heavy machinery to assist in transportation and installation. In fact, each column assembly 100 can be adjusted by one or two persons without the requirement for heavy equipment and with precision while upright, which eliminates the need to correct wood post lengths on site. Additionally, another advantage of using the present adjustable column assembly 100 is that post hole depths do not need to be exact, and the standard height industry variation of +/−3 inches is done away with. After the appropriate height adjustment is complete using the particular height adjustment mechanism 130, 300, 400 described above, the excavated holes 600 can be filled with concrete to set the adjustable foundation column assemblies 100 in place to create the foundation.

As described, the adjustable column assembly 100 is used to create the foundation for a structure, by acting as a base for attaching grade boards and post frame columns. Although it is common to use wood grade boards for creating the foundation of a structure, FIGS. 11-13 illustrate an alternative connection bracket and grade board combination 700 that can be attached/used with any column 900, which provides distinct advantages over use of traditional wood grade boards when building the foundation. FIG. 11 shows the connection bracket 710, which is designed to engage a grade board 800, as shown in FIG. 12. The bracket 710 includes an upper angled portion 712 and an opposing lower ledge 714, which are designed to engage and support a grade board 800, as shown in FIG. 12. The grade board 800 itself is constructed from a galvanized steel, which is coated with a proprietary coating (InterCoat® ChemGuard by Chemcoaters, Gary, Ind.) to improve the corrosion resistance of the galvanized steel. It should be understood that although the grade board 800 is shown in a short length for illustration, the grade board can be provided in any standard or customized foundation board lengths. The grade board 800 includes a first section 810 connected through a middle second 812 to an opposing second section 814, forming a substantially U-shaped configuration, which is complementary to the shape of the connection bracket 710 such that the grade board engages the bracket (FIG. 12). The first section 810 and second section 814 each includes a center, longitudinal ridge 816. Thus, the design of the center ridge 816 of the grade board 800 provides an option to stack and engage multiple grade boards one on top of the other, as shown in FIG. 13. Advantages of the connection bracket and grade board combination 700 include: configuration of connection bracket 710 permits easy, secure installation of the grade board 800, without requiring special tools, while the coated, galvanized steel grade board is not subject to deterioration, rotting, cupping, warping, crowning or twisting, resulting in a true straight, long-lasting foundation for a structure.

The features and advantages offered by the present height adjustable column assembly 100 mean that installation of the foundation column is quick, yet precise. Each column assembly 100 can be accurately put in place quickly, with a typical installation of an entire foundation for a post-frame structure being completed in a single day. The speed and precision of installation makes the height adjustable column assembly 100 ideal for stub-ahead projects; crews can dig, set the columns and install the splashboard prior to concrete backfill. This is also beneficial to the new building owner because it allows subsurface work (plumbing, electrical, in-floor heat, etc.) to be complete and concrete flooring poured prior to the crew returning to build the building.

In short, the time savings in installation combined with the durability of foundations built using the present adjustable column assembly 100 translate directly into improved safety, costs and labor savings when compared to other traditional foundation methods. The lightweight nature of the present column assembly 100 means the columns can essentially be set in place by hand by one or two persons, reducing or eliminating the need for tools and heavy equipment, making job sites safer and resulting in more efficient crews. Since column heights and overall leveling can be easily adjusted on site, supporting structural wood columns can arrive pre-cut and ready for attachment to the foundation system.

Advantages of the present height adjustable column assembly 100 include that it is invulnerable to the rot, decay and insect damage that traditional wooden posts are susceptible to, nor will the present foundation column expand and contract due to freezing and thawing. The superior strength of the galvanized steel foundation column of the present assembly 100 means that the structural foundation will never twist or warp, allowing foundations that utilize the present device and system to be more durable and well-protected against destructive natural forces than the average post frame building foundation.

As an alternative to new construction of a building, oftentimes there is a need or desire to repair and reinforce existing post-frame structures, specifically the wood foundation columns found in many post-frame structures, barns and other buildings. Repair or reinforcement is preferred in terms of time and costs over complete replacement of wooden columns in many of these structures. Additionally, razing a structure may not be an option if the structure has historical or family value.

Figure 15B:
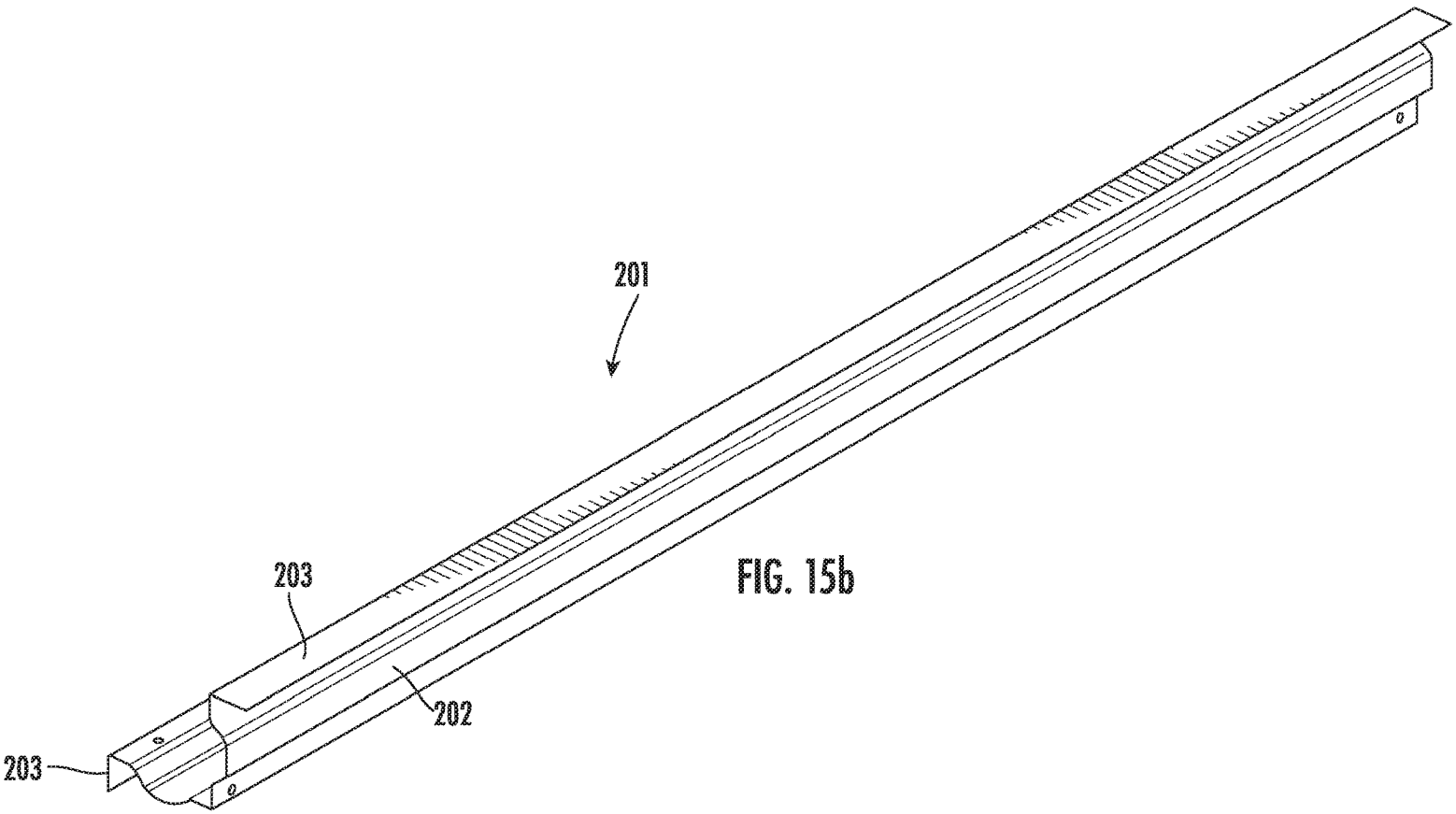
FIG. 15*b* illustrates a perspective view of an embodiment of a reinforcement sleeve according to the present disclosure.

As shown in FIGS. 14-17, an embodiment of a reinforcement device in the form of a multi-sided sleeve 200, is provided, which is useful for engagement with existing wooden columns 250 in post frame buildings. As illustrated in FIGS. 14 and 15, the reinforcement sleeve 200 includes an elongated body 210 comprising a longitudinal center section 212 integrally connected to a pair of opposing longitudinal legs 214 or side panels having a length equal to the center section. Each leg 214 includes multiple angles or bends 216. It should be understood that the angles or bends can vary in number and degree, and are adjustable for accommodating columns or posts of varying sizes. The resulting structure is a three-side configuration with an opening 218 that enables the sleeve to be adjusted and wrapped around three sides (the face and two sides) of an existing column 250 or post having a variety of shapes and sizes. Optionally, as shown in FIG. 15*b*, the sleeve 201 may include a slightly modified configuration, which is useful for corner or jamb columns. In this corner sleeve 201, the side panels 202 include an outer lip 203 configured for meeting the walls of a structure at the corner of the structure.

The reinforcement sleeve 200 has an overall corrugated shape, including a plurality of curved bends 216, folds or parallel and alternating ridges and grooves formed within the side panels 214 and the center section 212. For example, and as shown in FIG. 14, in one embodiment, the center section 212 is includes a raised center 212*a*. Additionally, each side panel 214 includes a raised portion 214*a* in each panel. The raised center 212*a* and side panel raised portions 212*a*, 214*a* provide the sleeve 200 with the adjustability to fit any shape of existing column 250, and lends strength to the sleeve. It should be understood that the raised portions 212*a* and 214*a* of the center section and side panels, respectively, can have any shape of bend, curve, ridges or grooves, and thus the disclosure should not be limited to the embodiment shown.

As shown in FIGS. 15 and 15*a*, the reinforcement sleeve 200 further includes at least one uplift tab 222 positioned on one or both of the side panels 214, The uplift tab 222 includes a plurality of teeth 224 (FIG. 11*a*). When the reinforcement sleeve 200 is placed over the existing wooden column 250, and driven down around the column with a suitable manual tool (i.e., hammer or maul), jack hammer, hydraulic device or another other suitable means for driving the sleeve into the ground, the teeth 224 of the uplift tab 222 engage into the sides of the column 250 (FIGS. 16 and 17). In this manner, the reinforcement sleeve 200 is secured around the wooden column 250, and it cannot be removed.

The reinforcement sleeve 200 can be constructed from any suitable material, preferably steel, including galvanized steel for strength, longevity and corrosion-resistance. Additionally, the reinforcement sleeve 200 can have any length required for the particular project. For example, a sleeve 200 used for strengthening an existing column or post may be shorter in length than a sleeve that will be used for extending the height of a structure. Once installed into the ground 230 around an existing support column 250, the reinforcement sleeve 200 can be secured to the existing support column, using any manner of fastener including nails, screws, bolts, etc., through fastener holes 220 on the sleeve. The reinforcement sleeve 200 acts to stiffen and reinforce the lower portion of the wooden column 250 against lateral, uplift, and downward pressures. Additionally, straps (not shown) may be used to further fasten the reinforcement sleeve 200 around the column 250 or post.

Installation of the reinforcement sleeve 200 may be completed with a specialty hydraulic driving device, similar to an automatic jack hammer, which mechanically drives the sleeve into the ground around the target column 250. An advantage of using the hydraulic driver is that it reduces the amount of digging required to place the reinforcement device 200 into position. Although a slight amount of digging may be required around the base of the post or column to initially place the reinforcement device 200, the driver secures the reinforcement device below grade using less time and manpower than traditionally required to place a second securing post. It should be understood that in place of the described driver, the reinforcement sleeve can also be installed using any suitable manual tool (i.e., hammer or maul), jack hammer, or another other suitable means for driving the sleeve into the ground.

Wood columns used to construct post frame buildings tend to fail over time due to dry rot and decay caused by microbial activity at the soil surface and just below the surface. This creates a risk of column failure or building damage, which is a real problem for the building owner, and can be very expensive to repair. The present disclosure also includes a system and method for reinforcing a column, post or other supporting structure for a building using the reinforcement device 200.

The system and method for reinforcing and/or stabilizing a column 250 or post includes the steps of initially digging a shallow hole 230 or trench around the base of the target column 250. The reinforcement sleeve 200 is then positioned within the hole 230 and over the existing column 250 from inside the building. Because of the corrugated shape of the reinforcement sleeve 200, the center section 212 and legs or side panels 214 of the sleeve cradle and contact the column at multiple contact points as shown in FIG. 14. For example, as noted in the figure, the raised portions 212*a*, 214*a* of each of the center section and legs do not directly contact the column 250. The corrugated shape of the reinforcement sleeve 200 provides strength and spacing needed to drive the sleeve into position around the column. If the sleeve 200 fit tight against the column 250, it would be harder to drive the sleeve down into position.

Although a reinforcement sleeve 200 is described as an option for reinforcing an existing wooden column, there is an option to use the height adjustable column assembly 100 described above in the repair of a structural column. Specifically, the existing column can be dug out of the ground and removed. The adjustable column assembly 100 would then be positioned in the ground, completely replacing the wooden column. Because the adjustable column assembly is not susceptible to the elements, or insect infestation, it would provide a long-term solution to maintaining the foundation of the existing building.

For decades, post frame buildings were built all across America that were designed to store equipment and machinery that was much smaller than what is in use on today's modern farms. As a result, many of these otherwise useful buildings are being removed to make room for new buildings with higher interior clearances. However, there is often a reason to save and restore existing buildings, including costs, historical value and sentimental value.

The present disclosure includes a system and method for raising the height of an existing structure by up to 36", thereby increasing the useful interior space. The system and method for raising the height of a structure includes using the present reinforcement sleeve 200. The reinforcement sleeve 200 can have any suitable length, for example up to 12 feet long, which makes the reinforcement sleeve useful for raising an older, shorter building to a newer height. Once the reinforcement sleeve 200 is installed around an existing column 250 as previously described, the existing wood columns can be extended up to 36", thereby increasing the interior clearance and allowing the height needed for today's modern farm equipment, construction equipment, or just to provide additional interior storage space within an existing structure.

The method of raising an existing structure begins with cutting an existing column will both sides and on the face of the column. The reinforcement sleeve 200 will be driven into the ground (using some form of a driver as described above), leaving a suitable portion of the sleeve above grade. The remaining portion of the column 250 would then be cut separating the column into two pieces. The building or structure would be jacked up or lifted incrementally using known methods and equipment (i.e., jacks), until it reached the desired height. The gap from the lift would be filled with appropriate filler. A vertical fastener, such as a steel strap would be used to fasten and tie all the pieces together, including the sleeve 200, which would also be attached to the column 250. After raising the structure to the desired height, any void left under the existing sidewall would be filled in with appropriate material, for example, a new steel wainscot.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

We claim:

1. A reinforcement device for constructing and supporting a foundation for a structure, the device comprising:
- a column body having a top and a bottom and an interior space;
- a bracket having a base secured to the top of the column body;
- a height adjustment mechanism including:
  - a rod with an outer threaded surface passing through an opening in the base of the bracket;
  - a guide tube extending vertically from an undersurface of the base into the interior space of the column body; and,
  - an extension rod extending upward through the interior space of the column body and into an interior of the guide tube, wherein the rod enters the interior of the guide tube for engagement with the extension rod to vertically move the column body and bracket between any desired height; and,
- a stabilizer pad secured to an end of the extension rod opposite the top of the column body.

2. The reinforcement device of claim 1, wherein the bracket comprises at least one upright arm connected to a horizontal plate forming the base.

3. The reinforcement device of claim 1, wherein the bracket comprises at least two opposing upright arms connected together by the base.

4. The reinforcement device of claim 3, wherein the bracket further includes a vertical back plate extending downward from the base and connecting the opposing arms.

5. The reinforcement device of claim 4 wherein at least one integrated side support is disposed on the vertical back plate.

6. The reinforcement device of claim 5, wherein the integrated side support is adapted to receive a board along the bracket.

7. The reinforcement device of claim 1, wherein the column body further comprises a cage formed from a plurality of vertical bars extending downward from and connected to the base of the bracket.

8. The reinforcement device of claim 7, wherein the vertical bars are interconnected by at least one reinforcement anchor positioned within the interior space of the column.

9. The reinforcement device of claim 7, wherein the vertical bars are interconnected by a plurality of reinforcement anchors horizontally positioned within the interior space of the column.

10. The reinforcement device of claim 9, wherein the guide tube passes vertically through a central opening of at least one reinforcement anchor.

11. The reinforcement device of claim 9, wherein the extension rod passes vertically through a central opening of at least one reinforcement anchor.

12. The reinforcement device of claim 1, wherein the guide tube includes a threaded nut disposed on a top end of the guide tube.

13. The reinforcement device of claim 1 wherein the rod is configured for engagement with the threaded nut of the guide tube.

14. The reinforcement device of claim 12, wherein the threaded nut and guide tube are spaced apart from the undersurface of the base.

15. The reinforcement device of claim 1, wherein the height adjustment mechanism comprises a three piece telescoping adjustment assembly.

16. The reinforcement device of claim 15, wherein the telescoping assembly includes a first rod disposed vertically above and passing through an opening in the bracket into a hollow cylinder disposed vertically from an undersurface of the base, wherein the first rod engages with a second extension rod disposed within an interior space of the cylinder.

17. The reinforcement device of claim 16, wherein the cylinder is adapted to receive the first rod in a telescoping manner for engagement with the second extension rod for moving the column body and bracket vertically between any desired height.

* * * * *